US009051931B2

(12) United States Patent
Locke et al.

(10) Patent No.: US 9,051,931 B2
(45) Date of Patent: Jun. 9, 2015

(54) SYSTEMS AND METHODS FOR REGULATING THE TEMPERATURE OF A DISC PUMP SYSTEM

(71) Applicant: KCI Licensing, Inc., San Antonio, TX (US)

(72) Inventors: Christopher Brian Locke, Bournemouth (GB); Aidan Marcus Tout, Alderbury (GB)

(73) Assignee: KCI Licensing, Inc., San Antonio, TX (US)

( * ) Notice: Subject to any disclaimer, the term of this patent is extended or adjusted under 35 U.S.C. 154(b) by 333 days.

(21) Appl. No.: 13/762,196

(22) Filed: Feb. 7, 2013

(65) Prior Publication Data

US 2013/0209279 A1 Aug. 15, 2013

Related U.S. Application Data

(60) Provisional application No. 61/597,477, filed on Feb. 10, 2012.

(51) Int. Cl.

| | |
|---|---|
| ***F04B 17/03*** | (2006.01) |
| ***F04B 53/08*** | (2006.01) |
| ***F04B 43/04*** | (2006.01) |
| ***F04F 7/00*** | (2006.01) |

(52) U.S. Cl.

CPC ..... *F04B 53/08* (2013.01); *F04B 43/046* (2013.01); *F04F 7/00* (2013.01)

(58) Field of Classification Search

CPC ..... F04B 43/046; F04B 43/043; F04B 53/08; F04B 43/028

USPC ..... 417/413.2, 413.3

See application file for complete search history.

(56) References Cited

U.S. PATENT DOCUMENTS

| | | | |
|---|---|---|---|
| 1,355,846 | A | 10/1920 | Rannells |
| 2,547,758 | A | 4/1951 | Keeling |
| 2,632,443 | A | 3/1953 | Lesher |
| 2,682,873 | A | 7/1954 | Evans et al. |

(Continued)

FOREIGN PATENT DOCUMENTS

| | | | |
|---|---|---|---|
| AU | 550575 | A1 | 3/1986 |
| AU | 745271 | | 4/1999 |

(Continued)

OTHER PUBLICATIONS

N. A. Bagautdinov, "Variant of External Vacuum Aspiration in the Treatment of Purulent Diseases of the Soft Tissues," Current Problems in Modern Clinical Surgery: Interdepartmental Collection, edited by V. Ye Volkov et al. (Chuvashia State University, Cheboksary, U.S.S.R. 1986);pp. 94-96 (copy and certified translation).

(Continued)

*Primary Examiner* — Charles Freay

(57) ABSTRACT

A disc pump system includes a pump body having a substantially cylindrical shape defining a cavity for containing a fluid, and an actuator operatively associated with the central portion of a driven end wall to cause an oscillatory motion of the driven end wall thereby generating displacement oscillations with an annular node between the center of the driven end wall and the side wall when in use. A heating element is thermally coupled to the actuator to maintain the actuator at a target temperature.

22 Claims, 18 Drawing Sheets

(56) References Cited

U.S. PATENT DOCUMENTS

| | | | | |
|---|---|---|---|---|
| 2,910,763 | A | 11/1959 | Lauterbach | |
| 2,969,057 | A | 1/1961 | Simmons | |
| 3,066,672 | A | 12/1962 | Crosby, Jr. et al. | |
| 3,367,332 | A | 2/1968 | Groves | |
| 3,520,300 | A | 7/1970 | Flower, Jr. | |
| 3,568,675 | A | 3/1971 | Harvey | |
| 3,648,692 | A | 3/1972 | Wheeler | |
| 3,682,180 | A | 8/1972 | McFarlane | |
| 3,826,254 | A | 7/1974 | Mellor | |
| 4,080,970 | A | 3/1978 | Miller | |
| 4,096,853 | A | 6/1978 | Weigand | |
| 4,139,004 | A | 2/1979 | Gonzalez, Jr. | |
| 4,165,748 | A | 8/1979 | Johnson | |
| 4,184,510 | A | 1/1980 | Murry et al. | |
| 4,233,969 | A | 11/1980 | Lock et al. | |
| 4,245,630 | A | 1/1981 | Lloyd et al. | |
| 4,256,109 | A | 3/1981 | Nichols | |
| 4,261,363 | A | 4/1981 | Russo | |
| 4,275,721 | A | 6/1981 | Olson | |
| 4,284,079 | A | 8/1981 | Adair | |
| 4,297,995 | A | 11/1981 | Golub | |
| 4,333,468 | A | 6/1982 | Geist | |
| 4,373,519 | A | 2/1983 | Errede et al. | |
| 4,382,441 | A | 5/1983 | Svedman | |
| 4,392,853 | A | 7/1983 | Muto | |
| 4,392,858 | A | 7/1983 | George et al. | |
| 4,419,097 | A | 12/1983 | Rowland | |
| 4,465,485 | A | 8/1984 | Kashmer et al. | |
| 4,475,909 | A | 10/1984 | Eisenberg | |
| 4,480,638 | A | 11/1984 | Schmid | |
| 4,525,166 | A | 6/1985 | Leclerc | |
| 4,525,374 | A | 6/1985 | Vaillancourt | |
| 4,540,412 | A | 9/1985 | Van Overloop | |
| 4,543,100 | A | 9/1985 | Brodsky | |
| 4,548,202 | A | 10/1985 | Duncan | |
| 4,551,139 | A | 11/1985 | Plaas et al. | |
| 4,569,348 | A | 2/1986 | Hasslinger | |
| 4,605,399 | A | 8/1986 | Weston et al. | |
| 4,608,041 | A | 8/1986 | Nielsen | |
| 4,640,688 | A | 2/1987 | Hauser | |
| 4,648,807 | A * | 3/1987 | Tippetts et al. | 417/413.2 |
| 4,655,754 | A | 4/1987 | Richmond et al. | |
| 4,664,662 | A | 5/1987 | Webster | |
| 4,710,165 | A | 12/1987 | McNeil et al. | |
| 4,733,659 | A | 3/1988 | Edenbaum et al. | |
| 4,743,232 | A | 5/1988 | Kruger | |
| 4,758,220 | A | 7/1988 | Sundblom et al. | |
| 4,787,888 | A | 11/1988 | Fox | |
| 4,826,494 | A | 5/1989 | Richmond et al. | |
| 4,838,883 | A | 6/1989 | Matsuura | |
| 4,840,187 | A | 6/1989 | Brazier | |
| 4,863,449 | A | 9/1989 | Therriault et al. | |
| 4,872,450 | A | 10/1989 | Austad | |
| 4,878,901 | A | 11/1989 | Sachse | |
| 4,897,081 | A | 1/1990 | Poirier et al. | |
| 4,906,233 | A | 3/1990 | Moriuchi et al. | |
| 4,906,240 | A | 3/1990 | Reed et al. | |
| 4,919,654 | A | 4/1990 | Kalt et al. | |
| 4,941,882 | A | 7/1990 | Ward et al. | |
| 4,953,565 | A | 9/1990 | Tachibana et al. | |
| 4,969,880 | A | 11/1990 | Zamierowski | |
| 4,985,019 | A | 1/1991 | Michelson | |
| 5,037,397 | A | 8/1991 | Kalt et al. | |
| 5,065,978 | A | 11/1991 | Albarda | |
| 5,086,170 | A | 2/1992 | Luheshi et al. | |
| 5,092,858 | A | 3/1992 | Benson et al. | |
| 5,100,396 | A | 3/1992 | Zamierowski | |
| 5,134,994 | A | 8/1992 | Say | |
| 5,149,331 | A | 9/1992 | Ferdman et al. | |
| 5,167,613 | A | 12/1992 | Karami et al. | |
| 5,176,663 | A | 1/1993 | Svedman et al. | |
| 5,215,522 | A | 6/1993 | Page et al. | |
| 5,232,453 | A | 8/1993 | Plass et al. | |
| 5,261,893 | A | 11/1993 | Zamierowski | |
| 5,278,100 | A | 1/1994 | Doan et al. | |
| 5,279,550 | A | 1/1994 | Habib et al. | |
| 5,298,015 | A | 3/1994 | Komatsuzaki et al. | |
| 5,342,376 | A | 8/1994 | Ruff | |
| 5,344,415 | A | 9/1994 | DeBusk et al. | |
| 5,358,494 | A | 10/1994 | Svedman | |
| 5,437,622 | A | 8/1995 | Carion | |
| 5,437,651 | A | 8/1995 | Todd et al. | |
| 5,527,293 | A | 6/1996 | Zamierowski | |
| 5,542,821 | A * | 8/1996 | Dugan | 417/53 |
| 5,549,584 | A | 8/1996 | Gross | |
| 5,556,375 | A | 9/1996 | Ewall | |
| 5,607,388 | A | 3/1997 | Ewall | |
| 5,636,643 | A | 6/1997 | Argenta et al. | |
| 5,645,081 | A | 7/1997 | Argenta et al. | |
| 6,071,267 | A | 6/2000 | Zamierowski | |
| 6,135,116 | A | 10/2000 | Vogel et al. | |
| 6,241,747 | B1 | 6/2001 | Ruff | |
| 6,287,316 | B1 | 9/2001 | Agarwal et al. | |
| 6,345,623 | B1 | 2/2002 | Heaton et al. | |
| 6,488,643 | B1 | 12/2002 | Tumey et al. | |
| 6,493,568 | B1 | 12/2002 | Bell et al. | |
| 6,553,998 | B2 | 4/2003 | Heaton et al. | |
| 6,814,079 | B2 | 11/2004 | Heaton et al. | |
| 2002/0077661 | A1 | 6/2002 | Saadat | |
| 2002/0115951 | A1 | 8/2002 | Norstrem et al. | |
| 2002/0120185 | A1 | 8/2002 | Johnson | |
| 2002/0143286 | A1 | 10/2002 | Tumey | |
| 2005/0089415 | A1 * | 4/2005 | Cho et al. | 417/413.2 |
| 2006/0239844 | A1 * | 10/2006 | Nakayama | 417/413.2 |
| 2009/0010779 | A1 * | 1/2009 | Hirata et al. | 417/413.2 |
| 2009/0214362 | A1 * | 8/2009 | Kanai | 417/413.2 |
| 2010/0310398 | A1 * | 12/2010 | Janse Van Rensburg et al. | 417/488 |
| 2012/0034109 | A1 | 2/2012 | Tout | |

FOREIGN PATENT DOCUMENTS

| | | | |
|---|---|---|---|
| AU | 755496 | | 2/2002 |
| CA | 2005436 | | 6/1990 |
| DE | 26 40 413 | A1 | 3/1978 |
| DE | 43 06 478 | A1 | 9/1994 |
| DE | 295 04 378 | U1 | 10/1995 |
| EP | 0100148 | A1 | 2/1984 |
| EP | 0117632 | A2 | 9/1984 |
| EP | 0161865 | A2 | 11/1985 |
| EP | 0358302 | A2 | 3/1990 |
| EP | 1018967 | B1 | 8/2004 |
| EP | 1489306 | A2 | 12/2004 |
| GB | 692578 | | 6/1953 |
| GB | 2 195 255 | A | 4/1988 |
| GB | 2 197 789 | A | 6/1988 |
| GB | 2 220 357 | A | 1/1990 |
| GB | 2 235 877 | A | 3/1991 |
| GB | 2 329 127 | B | 3/1999 |
| GB | 2 333 965 | A | 8/1999 |
| JP | 4129536 | | 4/1992 |
| SG | 71559 | | 4/2002 |
| WO | 80/02182 | | 10/1980 |
| WO | 87/04626 | | 8/1987 |
| WO | 90/10424 | | 9/1990 |
| WO | 93/09727 | | 5/1993 |
| WO | 94/20041 | | 9/1994 |
| WO | 96/05873 | | 2/1996 |
| WO | 97/18007 | | 5/1997 |
| WO | 99/13793 | | 3/1999 |
| WO | WO0218785 | A1 | 3/2002 |
| WO | WO2010139918 | A1 | 12/2010 |

OTHER PUBLICATIONS

Louis C. Argenta, MD and Michael J. Morykwas, PhD; "Vacuum-Assisted Closure: A New Method for Wound Control and Treatment: Animal Studies & Basic Foundation"; Annals of Plastic Surgery, vol. 38, No. 6, Jun. 1997; pp. 553-562.

Susan Mendez-Eastmen, RN; "When Wounds Won't Heal" RN Jan. 1998, vol. 61 (1); Medical Economics Company, Inc., Montvale, NJ, USA; pp. 20-24.

(56) References Cited

OTHER PUBLICATIONS

James H. Blackburn, II, MD, et al; "Negative-Pressure Dressings as a Bolster for Skin Grafts"; Annals of Plastic Surgery, vol. 40, No. 5, May 1998, pp. 453-457.
John Masters; "Reliable, Inexpensive and Simple Suction Dressings"; Letters to the Editor, British Journal of Plastic Surgery, 1998, vol. 51 (3), p. 267; Elsevier Science/The British Association of Plastic Surgeons, UK.
S.E. Greer, et al "The Use of Subatmospheric Pressure Dressing Therapy to Close Lymphocutaneous Fistulas of the Groin" British Journal of Plastic Surgery (2000), vol. 53, pp. 484-487.
George V. Letsou, MD., et al; "Stimulation of Adenylate Cyclase Activity in Cultured Endothelial Cells Subjected to Cyclic Stretch"; Journal of Cardiovascular Surgery, vol. 31, 1990, pp. 634-639.
Orringer, Jay, et al; "Management of Wounds in Patients with Complex Enterocutaneous Fistulas"; Surgery, Gynecology & Obstetrics, Jul. 1987, vol. 165, pp. 79-80.
International Search Report for PCT International Application PCT1GB95/01983; Nov. 23, 1995.
PCT International Search Report for PCT International Application PCT/GB98/02713; Jan. 8, 1999.
PCT Written Opinion; PCT International Application PCT/GB98/02713; Jun. 8, 1999.
PCT International Examination and Search Report, PCT International Application PCT/GB96/02802; Jan. 15, 1998 & Apr. 29, 1997.
PCT Written Opinion, PCT International Application PCT/GB96/02802; Sep. 3, 1997.
Dattilo, Philip P., JR., et al; "Medical Textiles: Application of an Absorbable Barbed Bi-directional Surgical Suture"; Journal of Textile and Apparel, Technology and Management, vol. 2, Issue 2, Spring 2002, pp. 1-5.
Kostyuchenok, B.M., et al; "Vacuum Treatment in the Surgical Management of Purulent Wounds"; Vestnik Khirurgi, Sep. 1986, pp. 18-21 and 6 page English translation thereof.
Davydov, Yu. A., et al; "Vacuum Therapy in the Treatment of Purulent Lactation Mastitis"; Vestnik Khirurgi, May 14, 1986, pp. 66-70, and 9 page English translation thereof.
Yusupov. Yu. N., et al; "Active Wound Drainage", Vestnik Khirurgi, vol. 138, Issue 4, 1987, and 7 page English translation thereof.
Davydov, Yu. A., et al; "Bacteriological and Cytological Assessment of Vacuum Therapy for Purulent Wounds"; Vestnik Khirurgi, Oct. 1988, pp. 48-52, and 8 page English translation thereof.
Davydov, Yu. A., et al; "Concepts for the Clinical-Biological Management of the Wound Process in the Treatment of Purulent Wounds by Means of Vacuum Therapy"; Vestnik Khirurgi, Jul. 7, 1980, pp. 132-136, and 8 pages English translation thereof.
Chariker, Mark E., M.D., et al; "Effective Management of incisional and cutaneous fistulae with closed suction wound drainage"; Contemporary Surgery, vol. 34, Jun. 1989, pp. 59-63.
Egnell Minor, Instruction Book, First Edition, 300 7502, Feb. 1975, pp. 24.
Egnell Minor: Addition to the Users Manual Concerning Overflow Protection—Concerns all Egnell Pumps, Feb. 3, 1983, p. 1.
Svedman, P.: "Irrigation Treatment of Leg Ulcers", The Lancet, Sep. 3, 1983, pp. 532-534.
Chinn, Steven D. et al.: "Closed Wound Suction Drainage", The Journal of Foot Surgery, vol. 24, No. 1, 1985, pp. 76-81.
Arnljots, Björn et al.: "Irrigation Treatment in Split-Thickness Skin Grafting of Intractable Leg Ulcers", Scand J. Plast Reconstr. Surg., vol. 19, 1985, pp. 211-213.
Svedman, P.: "A Dressing Allowing Continuous Treatment of a Biosurface", IRCS Medical Science: Biomedical Technology, Clinical Medicine, Surgery and Transplantation, vol. 7, 1979, p. 221.
Svedman, P. et al.: " A Dressing System Providing Fluid Supply and Suction Drainage Used for Continuous or Intermittent Irrigation", Annals of Plastic Surgery, vol. 17, No. 2, Aug. 1986, pp. 125-133.
K.F. Jeter, T.E. Tintle, and M. Chariker, "Managing Draining Wounds and Fistulae: New and Established Methods," Chronic Wound Care, edited by D. Krasner (Health Management Publications, Inc., King of Prussia, PA 1990), pp. 240-246.
G. Živadinovic, V. Đukić, Ž. Maksimovioć, Đ. Radak, and P. Pešška, "Vacuum Therapy in the Treatment of Peripheral Blood Vessels," Timok Medical Journal 11 (1986), pp. 161-164 (copy any certified translation).
F.E. Johnson, "An Improved Technique for Skin Graft Placement Using a Suction Drain," Surgery, Gynecology, and Obstetrics 159 (1984), pp. 584-585.
A.A. Safronov, Dissertation Abstract, Vacuum Therapy of Trophic Ulcers of the Lower Leg with Simultaneous Autoplasty of the Skin (Central Scientific Research Institute of Traumatology and Orthopedics, Moscow, U.S.S.R. 1967) (copy and cerified translation).
M. Schein, R. Saadia, J.R. Jamieson, and G.A.G. Decker, "The 'Sandwich Technique' in the Management of the Open Abdomen," British Journal of Surgery 73 (1986), pp. 369-370.
D.E. Tribble, "An Improved Sump Drain-Irrigation Device of Simple Construction," Archives of Surgery 105 (1972) pp. 511-513.
C.E. Tennant, "The Use of Hypermia in the Postoperative Treatment of Lesions of the Extremities and Thorax," Journal of the American Medical Association 64 (1915), pp. 1548-1549.
Selections from W. Meyer and V. Schmieden, Bier's Hyperemic Treatment in Surgery, Medicine, and the Specialties: A Manual of Its Practical Application, (W.B. Saunders Co., Philadelphia, PA 1909), pp. 17-25, 44-64, 90-96, 167-170, and 210-211.
V.A. Solovev et al., Guidelines, The Method of Treatment of Immature External Fistulas in the Upper Gastrointestinal Tract, editor-in-chief Prov. V.I. Parahonyak (S.M. Kirov Gorky State Medical Institute, Gorky, U.S.S.R. 1987) ("Solovev Guidelines").
V.A. Kuznetsov & N.A. Bagautdinov, "Vacuum and Vacuum-Sorption Treatment of Open Septic Wounds," in II All-Union Conference on Wounds and Wound Infections: Presentation Abstracts, edited by B.M. Kostyuchenok et al. (Moscow, U.S.S.R. Oct. 28-29, 1986) pp. 91-92 ("Bagautdinov II").
V.A. Solovev, Dissertation Abstract, Treatment and Prevention of Suture Failures after Gastric Resection (S.M. Kirov Gorky State Medical Institute, Gorky, U.S.S.R. 1988) ("Solovev Abstract").
V.A.C.® Therapy Clinical Guidelines: A Reference Source for Clinicians (Jul. 2007).
International Search Report corresponding to PCT, May 28, 2014.
Written Opinion corresponding to PCT, May 28, 2014.

* cited by examiner $t_p$-
$t_p$+
CAVITY PRESSURE 17
AMBIENT PRESSURE
P
TIME

OPEN
VALVE 29
CLOSED
$\delta_{gap}$
TIME
ACTUATOR VALVE 32
OPEN

FLOW+
VALVE 29
229
229
229x
229x
FLOW-
TIME
329
329
FLOW+
ACTUATOR VALVE 32
232
232
232x
232x
FLOW-
TIME
332
332

300
302
304
311
312
313
314
315
kHz
90
45
0
-45
-90
10000
1000
100
10
0
50
100
150
200
250

370 (50%)
380 (43%)
371
372
373
374
375
376
377
378
379
381
382
383
384
385
387
388
389
An
1.6
1.4
1.2
1.0
0.8
0.6
0.4
0.2
n
1
2
3
4
5
6
7
8
9

SYSTEMS AND METHODS FOR REGULATING THE TEMPERATURE OF A DISC PUMP SYSTEM

The present invention claims the benefit, under 35 USC §119(e), of the filing of U.S. Provisional Patent Application Ser. No. 61/597,477, entitled "Systems and Methods for Regulating the Temperatures of a Disc Pump System," filed Feb. 10, 2012, by Locke et al., which is incorporated herein by reference for all purposes.

BACKGROUND OF THE INVENTION

1. Field of the Invention

The illustrative embodiments of the invention relate generally to a disc pump for fluid and, more specifically, to a disc pump in which the pumping cavity is substantially cylindrically shaped having end walls and a side wall between the end walls with an actuator disposed between the end walls. The illustrative embodiments of the invention relate more specifically to a disc pump having a valve mounted in the actuator and at least one additional valve mounted in one of the end walls.

2. Description of Related Art

The generation of high amplitude pressure oscillations in closed cavities has received significant attention in the fields of thermo-acoustics and disc pump type compressors. Recent developments in non-linear acoustics have allowed the generation of pressure waves with higher amplitudes than previously thought possible.

It is known to use acoustic resonance to achieve fluid pumping from defined inlets and outlets. This can be achieved using a cylindrical cavity with an acoustic driver at one end, which drives an acoustic standing wave. In such a cylindrical cavity, the acoustic pressure wave has limited amplitude. Varying cross-section cavities, such as cone, horn-cone, and bulb shapes have been used to achieve high amplitude pressure oscillations thereby significantly increasing the pumping effect. In such high amplitude waves the non-linear mechanisms with energy dissipation have been suppressed. However, high amplitude acoustic resonance has not been employed within disc-shaped cavities in which radial pressure oscillations are excited until recently. International Patent Application No. PCT/GB2006/001487, published as WO 2006/111775, discloses a disc pump having a substantially disc-shaped cavity with a high aspect ratio, i.e., the ratio of the radius of the cavity to the height of the cavity.

Such a disc pump has a substantially cylindrical cavity comprising a side wall closed at each end by end walls. The disc pump also comprises an actuator that drives either one of the end walls to oscillate in a direction substantially perpendicular to the surface of the driven end wall. The spatial profile of the motion of the driven end wall is described as being matched to the spatial profile of the fluid pressure oscillations within the cavity, a state described herein as mode-matching. When the disc pump is mode-matched, work done by the actuator on the fluid in the cavity adds constructively across the driven end wall surface, thereby enhancing the amplitude of the pressure oscillation in the cavity and delivering high disc pump efficiency. The efficiency of a mode-matched disc pump is dependent upon the interface between the driven end wall and the side wall. It is desirable to maintain the efficiency of such a disc pump by structuring the interface so that it does not decrease or dampen the motion of the driven end wall, thereby mitigating any reduction in the amplitude of the fluid pressure oscillations within the cavity.

The actuator of the disc pump described above causes an oscillatory motion of the driven end wall ("displacement oscillations") in a direction substantially perpendicular to the end wall or substantially parallel to the longitudinal axis of the cylindrical cavity, referred to hereinafter as "axial oscillations" of the driven end wall within the cavity. The axial oscillations of the driven end wall generate substantially proportional "pressure oscillations" of fluid within the cavity creating a radial pressure distribution approximating that of a Bessel function of the first kind as described in International Patent Application No. PCT/GB2006/001487, which is incorporated by reference herein, such oscillations referred to hereinafter as "radial oscillations" of the fluid pressure within the cavity. A portion of the driven end wall between the actuator and the side wall provides an interface with the side wall of the disc pump that decreases damping of the displacement oscillations to mitigate any reduction of the pressure oscillations within the cavity. The portion of the driven end wall between the actuator and the sidewall is hereinafter referred to as an "isolator" and is described more specifically in U.S. patent application Ser. No. 12/477,594, which is incorporated by reference herein. The illustrative embodiments of the isolator are operatively associated with the peripheral portion of the driven end wall to reduce damping of the displacement oscillations.

Such disc pumps also require one or more valves for controlling the flow of fluid through the disc pump and, more specifically, valves being capable of operating at high frequencies. Conventional valves typically operate at lower frequencies below 500 Hz for a variety of applications. For example, many conventional compressors typically operate at 50 or 60 Hz. Linear resonance compressors that are known in the art operate between 150 and 350 Hz. However, many portable electronic devices including medical devices require disc pumps for delivering a positive pressure or providing a vacuum that are relatively small in size and it is advantageous for such disc pumps to be inaudible in operation so as to provide discrete operation. To achieve these objectives, such disc pumps must operate at very high frequencies requiring valves capable of operating at about 20 kHz and higher. To operate at these high frequencies, the valve must be responsive to a high frequency oscillating pressure that can be rectified to create a net flow of fluid through the disc pump. Such a valve is described more specifically in International Patent Application No. PCT/GB2009/050614, which is incorporated by reference herein.

Valves may be disposed in either a first or second aperture, or both apertures, for controlling the flow of fluid through the disc pump. Each valve comprises a first plate having apertures extending generally perpendicular therethrough and a second plate also having apertures extending generally perpendicular therethrough, wherein the apertures of the second plate are substantially offset from the apertures of the first plate. The valve further comprises a sidewall disposed between the first and second plate, wherein the sidewall is closed around the perimeter of the first and second plates to form a cavity between the first and second plates in fluid communication with the apertures of the first and second plates. The valve further comprises a flap disposed and moveable between the first and second plates, wherein the flap has apertures substantially offset from the apertures of the first plate and substantially aligned with the apertures of the second plate. The flap is motivated between the first and second plates in response to a change in direction of the differential pressure of the fluid across the valve.

SUMMARY

A disc pump system comprises a pump body having a substantially cylindrical shape defining a cavity for containing a fluid, the cavity being formed by a side wall closed at both ends by substantially circular end walls. At least one of the end walls is a driven end wall having a central portion and a peripheral portion extending radially outwardly from the central portion of the driven end wall. The system includes an actuator operatively associated with the central portion of the driven end wall to cause an oscillatory motion of the driven end wall at a frequency (f), thereby generating displacement oscillations of the driven end wall in a direction substantially perpendicular thereto. The frequency (f) is about equal to a fundamental bending mode of the actuator. An isolator is operatively associated with the peripheral portion of the driven end wall to reduce damping of the displacement oscillations. The isolator comprises a flexible printed circuit material. The system includes a first aperture disposed at any location in either one of the end walls other than at the annular node and extending through the pump body and a second aperture disposed at any location in the pump body other than the location of the first aperture and extending through the pump body. The system also includes a valve disposed in at least one of the first aperture and the second aperture. The displacement oscillations generate corresponding pressure oscillations of the fluid within the cavity of the pump body causing fluid flow through the first and second apertures when in use. The system includes a heating element that is thermally coupled to the actuator and operable to raise the temperature of the actuator to a target temperature.

A method for maintaining the operating temperature of a disc pump comprises obtaining a temperature measurement, the temperature measurement indicative of the temperature of an actuator of a disc pump. The method also includes transmitting the temperature measurement to a microcontroller and determining if a temperature of the actuator is less than a target temperature. In response to determining that the temperature of the actuator is less than the target temperature, the method also includes activating a heating element that is thermally coupled to the actuator.

A disc pump comprises a pump body having a substantially cylindrical shape defining a cavity for containing a fluid. The cavity is formed a side wall closed at both ends by substantially circular end walls and at least one of the end walls is a driven end wall having a central portion and a peripheral portion that extends radially outwardly from the central portion of the driven end wall. The disc pump includes an actuator operatively associated with the central portion of the driven end wall to cause an oscillatory motion of the driven end wall at a frequency (f) thereby generating displacement oscillations of the driven end wall in a direction substantially perpendicular thereto. The frequency (f) is about equal to a fundamental bending mode of the actuator. The disc pump further includes a drive circuit having an output electrically coupled to the actuator for providing the drive signal to the actuator at the frequency (f). In addition, the disc pump includes an isolator operatively associated with the peripheral portion of the driven end wall to reduce damping of the displacement oscillations. The isolator comprises a flexible printed circuit material. The disc pump includes a first aperture disposed at any location in either one of the end walls other than at the annular node and extending through the pump body, as well as a second aperture disposed at any location in the pump body other than the location of the first aperture and extending through the pump body. A valve is disposed in at least one of the first aperture and the second aperture such that displacement oscillations generate corresponding pressure oscillations of the fluid within the cavity of the pump body causing fluid flow through the first aperture and second aperture when in use. A heating element is thermally coupled to a power source via conductive elements that are integral to the isolator.

Other features and advantages of the illustrative embodiments will become apparent with reference to the drawings and detailed description that follow.

DETAILED DESCRIPTION OF ILLUSTRATIVE EMBODIMENTS

In the following detailed description of illustrative embodiments, reference is made to the accompanying drawings that form a part hereof. By way of illustration, the accompanying drawings show specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1:
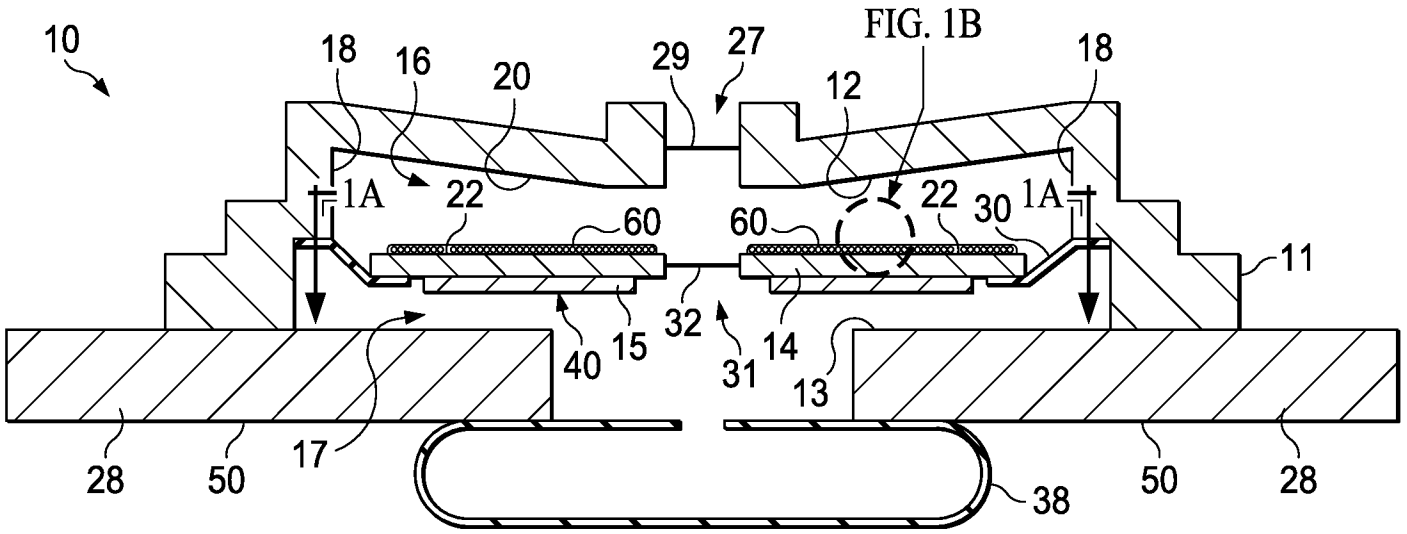
FIG. 1 is a cross-section view of a disc pump.

FIG. 1 is a side, cross-section view of a disc pump system 100 comprising a disc pump 10, a substrate 28 on which the disc pump 10 is mounted, and a load 38 that is fluidly coupled to the disc pump 10. The disc pump 10 is operable to supply a positive or negative pressure to the load 38, as described in more detail below. The disc pump 10 includes an actuator 40 coupled to a cylindrical wall 11 of the disc pump 10 by an isolator 30, which comprises a flexible material.

Figure 1A:
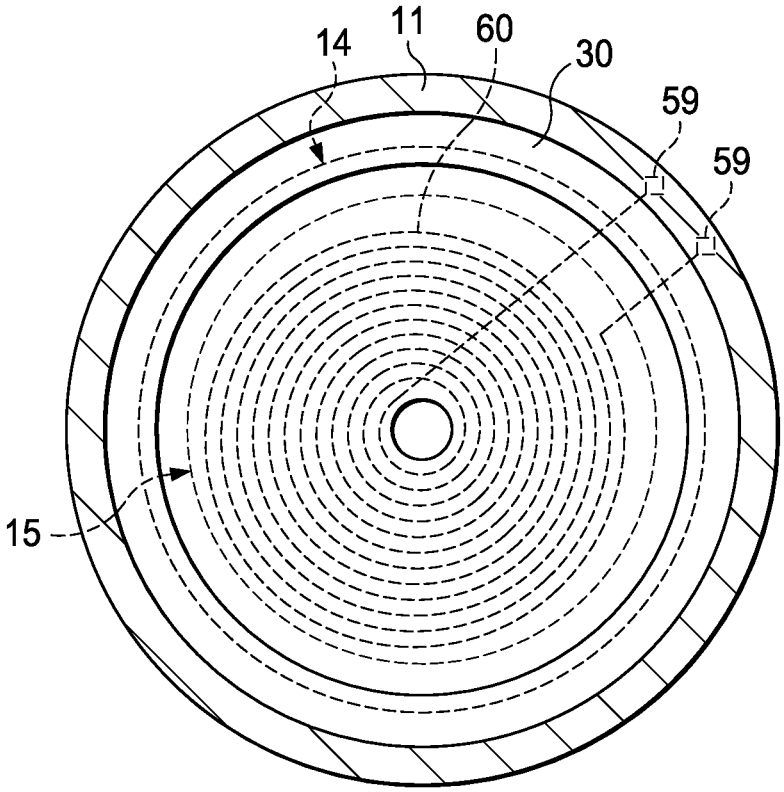
FIG. 1A is a top, section view of the disc pump of FIG. 1 taken along the line 1A-1A and showing an isolator and an actuator of the disc pump, including a heating element thermally coupled to the actuator.

FIG. 1A is a top view of a section of the disc pump system 100 that includes the actuator 40 and the isolator 30. In one embodiment, the isolator 30 is formed from a flexible printed circuit material that may include circuit elements. Generally, the flexible printed circuit material comprises a flexible polymer film that provides a foundation layer for the isolator 30. The polymer may be a polyester (PET), polyimide (PI), polyethylene napthalate, (PEN), polyetherimide (PEI), or a material with similar mechanical and electrical properties. The flexible circuit material may include one or more a laminate layers formed of a bonding adhesive. In addition, a metal foil, such as a copper foil, may be used to provide one or more conductive layers to the flexible printed circuit material. The conductive layer is usable to form circuit elements by, for example, etching circuit paths into the conductive layer. The conductive layer may be applied to the foundation layer by rolling (with or without an adhesive) or by electro-deposition. The isolator 30 may also include other distinct electronic devices.

Figure 1B:
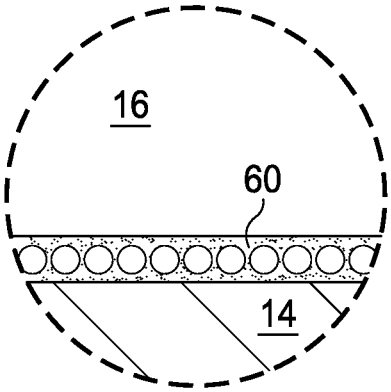
FIG. 1B is a detail, cross-section view of a portion of the disc pump showing the actuator and the heating element adjacent to the actuator.

FIG. 1B is a detail, section view of a portion of the disc pump system 100 that includes the actuator 40 and a heating element 60. In the illustrative embodiment of FIG. 1B, the heating element 60 is embedded within a layer of material that is adjacent the actuator 40. The layer of material may be an extension of the isolator 30 or another suitable material that is adjacent the actuator 40. The heating element 60 may be coupled to a power source via circuit elements that are integral to the isolator 30, e.g., conductive traces that are formed in a flexible printed circuit material that forms the isolator 30. The layer of material may comprise a thermally conductive material that does not dampen the motion of the actuator 40, such as a thermally conductive polymer. In another embodiment, the heating element 60 may be installed adjacent the actuator 40 without the layer of material. In such an embodiment, the heating element 60 may be thermally coupled to the actuator 40 by direct contact or by using a thin layer of thermally conductive grease. In another embodiment, the heating element 60 may be included in the isolator 30 only and thermally coupled to only a peripheral portion of the actuator 40. In such an embodiment, the interior plates 14, 15 of the actuator 40 are sufficiently conductive to maintain a consistent temperature throughout the actuator 40.

In an illustrative embodiment, the isolator 30 includes contacts 59 that couple a power source (not shown) to the heating element 60 that is thermally coupled to the actuator 40. The heating element 60 may function to keep the actuator 40 at a relatively constant temperature. The heating element 60 is a resistive heating element that converts electrical energy into heat, though other heat generation mechanisms may be substituted depending on the application. The heating element 60 may be formed from a nickel-chromium alloy or any other suitable material, including aluminum alloys, copper-nickel alloys, molybdenum disilicide, and ceramics having a positive thermal coefficient.

Figure 2A:
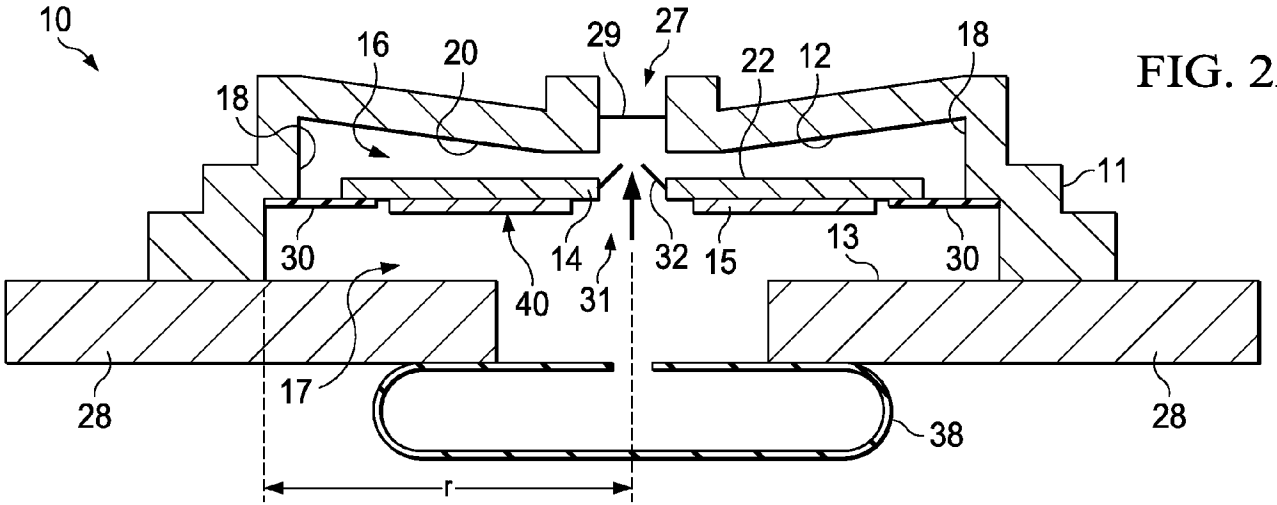
FIG. 2A shows a cross-section view of the disc pump of FIG. 1 having an actuator shown in a rest position.

FIG. 2A is a cross-section view of the disc pump 10 shown in FIG. 1. The disc pump 10 comprises a disc pump body having a substantially elliptical shape including a cylindrical wall 11 closed at each end by end plates 12, 13. The cylindrical wall 11 may be mounted to a substrate 28, which forms the end plate 13. The substrate 28 may be a printed circuit board or another suitable material. The disc pump 10 further comprises a pair of disc-shaped interior plates 14, 15 supported within the disc pump 10 by the isolator 30 affixed to the cylindrical wall 11 of the disc pump body. The isolator 30 of the disc pump 10 is a ring-shaped isolator. The internal surfaces of the cylindrical wall 11, the end plate 12, the interior plate 14, and the ring-shaped isolator 30 form a cavity 16 within the disc pump 10. The internal surfaces of the cavity 16 comprise a side wall 18 which is a first portion of the inside surface of the cylindrical wall 11 that is closed at both ends by end walls 20, 22 wherein the end wall 20 is the internal surface of the end plate 12 and the end wall 22 comprises the internal surface of the interior plate 14 and a first side of the isolator 30. The end wall 22 thus comprises a central portion corresponding to the inside surface of the interior plate 14 and a peripheral portion corresponding to the inside surface of the ring-shaped isolator 30. Although the disc pump 10 and its components are substantially elliptical in shape, the specific embodiment disclosed herein is a circular, elliptical shape.

The cylindrical wall 11 and the end plates 12, 13 may be a single component comprising the disc pump body or separate components, as shown in FIG. 2A, wherein the end plate 13 is formed by a separate substrate that may be a printed circuit board, an assembly board, or printed wire assembly (PWA) on which the disc pump 10 is mounted. Although the cavity 16 is substantially circular in shape, the cavity 16 may also be more generally elliptical in shape. In the embodiment shown in FIG. 2A, the end wall 20 defining the cavity 16 is shown as being generally frusto-conical. In another embodiment, the end wall 20 defining the inside surfaces of the cavity 16 may include a generally planar surface that is parallel to the actuator 40, discussed below. A disc pump comprising frusto-conical surfaces is described in more detail in the WO2006/111775 publication, which is incorporated by reference herein. The end plates 12, 13 and cylindrical wall 11 of the disc pump body may be formed from any suitable rigid material including, without limitation, metal, ceramic, glass, or plastic including, without limitation, inject-molded plastic.

The interior plates 14, 15 of the disc pump 10 together form an actuator 40 that is operatively associated with the central portion of the end wall 22, which forms the internal surfaces of the cavity 16. One of the interior plates 14, 15 must be formed of a piezoelectric material which may include any electrically active material that exhibits strain in response to an applied electrical signal, such as, for example, an electrostrictive or magnetostrictive material. In one preferred embodiment, for example, the interior plate 15 is formed of piezoelectric material that exhibits strain in response to an applied electrical signal, i.e., the active interior plate. The other one of the interior plates 14, 15 preferably possesses a bending stiffness similar to the active interior plate and may be formed of a piezoelectric material or an electrically inactive material, such as a metal or ceramic. In this preferred embodiment, the interior plate 14 possesses a bending stiffness similar to the active interior plate 15 and is formed of an electrically inactive material, such as a metal or ceramic, i.e., the inert interior plate. When the active interior plate 15 is excited by an electrical current, the active interior plate 15 expands and contracts in a radial direction relative to the longitudinal axis of the cavity 16, causing the interior plates 14, 15 to bend, thereby inducing an axial deflection of the end walls 22 in a direction substantially perpendicular to the end walls 22 (See FIG. 3A).

In other embodiments not shown, the isolator 30 may support either one of the interior plates 14, 15, whether the active interior plate 15 or the inert interior plate 14, from the top or the bottom surfaces depending on the specific design and orientation of the disc pump 10. In another embodiment, the actuator 40 may be replaced by a device in a force-transmitting relation with only one of the interior plates 14, 15 such as, for example, a mechanical, magnetic or electrostatic device, wherein the selected interior plate 14, 15 may be formed as an electrically inactive or passive layer of material driven into oscillation by such device (not shown) in the same manner as described above.

Figure 2B:
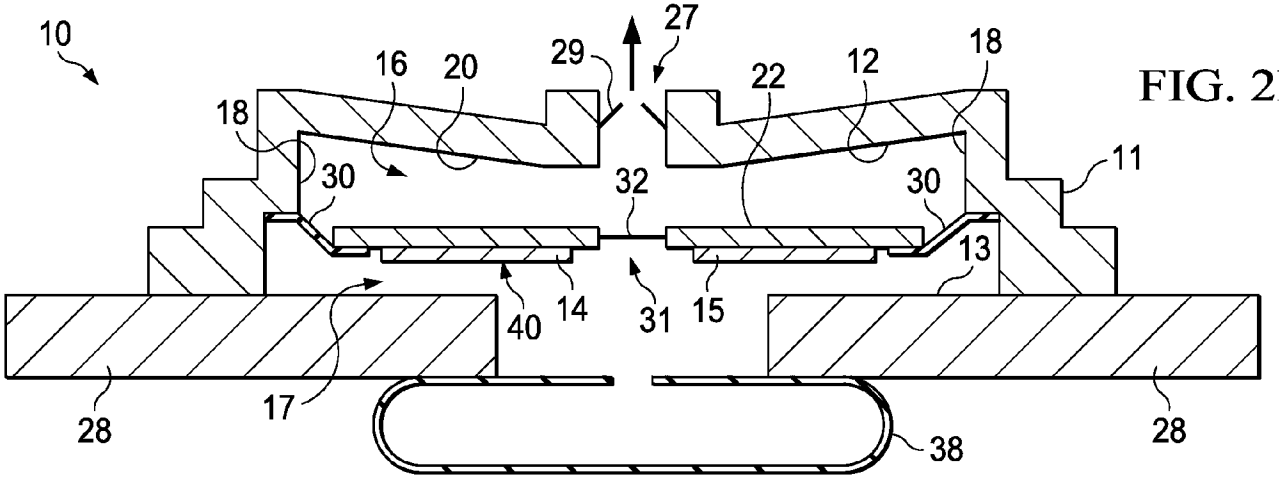
FIG. 2B shows a cross-section view of the disc pump of FIG. 1 with the actuator shown in a displaced position.

The disc pump 10 further comprises at least one aperture extending from the cavity 16 to the outside of the disc pump 10, wherein the at least one aperture contains a valve to control the flow of fluid through the aperture. Although the aperture may be located at any position in the cavity 16 where the actuator 40 generates a pressure differential as described below in more detail, one embodiment of the disc pump 10 shown in FIGS. 2A-2B comprises an outlet aperture 27, located at approximately the center of and extending through the end plate 12. The aperture 27 contains at least one end valve 29. In one preferred embodiment, the aperture 27 contains end valve 29 which regulates the flow of fluid in one direction as indicated by the arrows so that end valve 29 functions as an outlet valve for the disc pump 10. Any reference to the aperture 27 that includes the end valve 29 refers to that portion of the opening outside of the end valve 29, i.e., outside the cavity 16 of the disc pump 10.

The disc pump 10 further comprises at least one aperture extending through the actuator 40, wherein the at least one aperture contains a valve to control the flow of fluid through the aperture. The aperture may be located at any position on the actuator 40 where the actuator 40 generates a pressure differential. The illustrative embodiment of the disc pump 10 shown in FIGS. 2A-2B, however, comprises an actuator aperture 31 located at approximately the center of and extending through the interior plates 14, 15. The actuator aperture 31 contains an actuator valve 32 which regulates the flow of fluid in one direction into the cavity 16, as indicated by the arrow so that the actuator valve 32 functions as an inlet valve to the cavity 16. The actuator valve 32 enhances the output of the disc pump 10 by augmenting the flow of fluid into the cavity 16 and supplementing the operation of the outlet valve 29 as described in more detail below.

The dimensions of the cavity 16 described herein should preferably satisfy certain inequalities with respect to the relationship between the height (h) of the cavity 16 at the side wall 18 and its radius (r) which is the distance from the longitudinal axis of the cavity 16 to the side wall 18. These equations are as follows:

$$r/h>1.2;\text{ and}$$

$$h^2/r>4\times10^{-10}\text{ meters.}$$

In one embodiment, the ratio of the cavity radius to the cavity height (r/h) is between about 10 and about 50 when the fluid within the cavity 16 is a gas. In this example, the volume of the cavity 16 may be less than about 10 ml. Additionally, the ratio of $h^2/r$ is preferably within a range between about $10^{-6}$ meters and about $10^{-7}$ meterswhere the working fluid is a gas as opposed to a liquid.

Additionally, the cavity 16 disclosed herein should preferably satisfy the following inequality relating the cavity radius (r) and operating frequency (f), which is the frequency at which the actuator 40 vibrates to generate the axial displacement of the end wall 22. The inequality is as follows:

$$\frac{k_0(c_s)}{2\pi f} \le r \le \frac{k_0(c_f)}{2\pi f} \qquad \text{[Equation 1]}$$

wherein the speed of sound in the working fluid within the cavity 16 ($c$) may range between a slow speed ($c_s$) of about 115 m/s and a fast speed ($c_f$) equal to about 1,970 m/s as expressed in the equation above, and $k_0$ is a constant ($k_0$=3.83). The frequency of the oscillatory motion of the actuator 40 is preferably about equal to the lowest resonant frequency of radial pressure oscillations in the cavity 16, but may be within 20% of that value. The lowest resonant frequency of radial pressure oscillations in the cavity 16 is preferably greater than about 500 Hz.

Although it is preferable that the cavity 16 disclosed herein should satisfy individually the inequalities identified above, the relative dimensions of the cavity 16 should not be limited to cavities having the same height and radius. For example, the cavity 16 may have a slightly different shape requiring different radii or heights creating different frequency responses so that the cavity 16 resonates in a desired fashion to generate the optimal output from the disc pump 10.

In operation, the disc pump 10 may function as a source of positive pressure adjacent the outlet valve 29 to pressurize a load 38 or as a source of negative or reduced pressure adjacent the actuator inlet valve 32 to depressurize a load 38, as illustrated by the arrows. For example, the load may be a tissue treatment system that utilizes negative pressure for treatment. The term "reduced pressure" as used herein generally refers to a pressure less than the ambient pressure where the disc pump 10 is located. Although the term "vacuum" and "negative pressure" may be used to describe the reduced pressure, the actual pressure reduction may be significantly less than the pressure reduction normally associated with a complete vacuum. The pressure is "negative" in the sense that it is a gauge pressure, i.e., the pressure is reduced below ambient atmospheric pressure. Unless otherwise indicated, values of pressure stated herein are gauge pressures. References to increases in reduced pressure typically refer to a decrease in absolute pressure, while decreases in reduced pressure typically refer to an increase in absolute pressure.

As indicated above, the disc pump 10 comprises at least one actuator valve 32 and at least one end valve 29. In another embodiment, the disc pump 10 may comprise a two cavity disc pump having an end valve 29 on each side of the actuator 40.

Figure 3A:
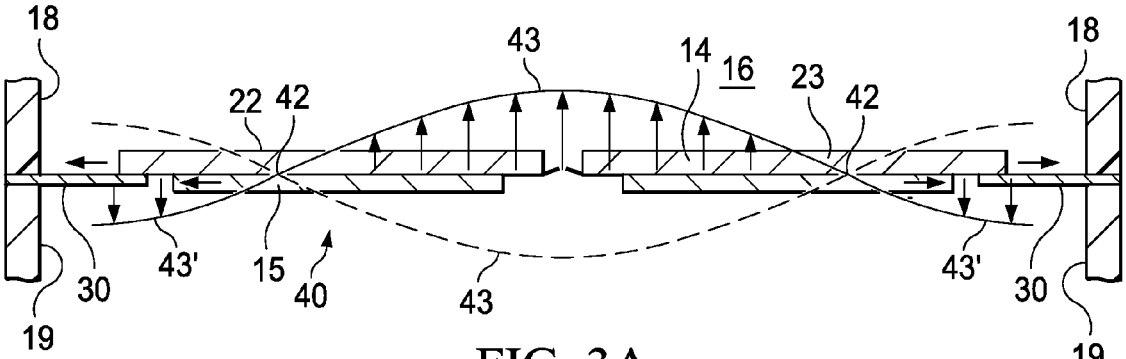
FIG. 3A shows a graph of the axial displacement oscillations for the fundamental bending mode of an actuator of the disc pump of FIG. 1.

FIG. 3A shows one possible displacement profile illustrating the axial oscillation of the driven end wall 22 of the cavity 16. The solid curved line and arrows represent the displacement of the driven end wall 22 at one point in time, and the dashed curved line represents the displacement of the driven end wall 22 one half-cycle later. The displacement as shown in this figure and the other figures is exaggerated. Because the actuator 40 is not rigidly mounted at its perimeter, and is instead suspended by the ring-shaped isolator 30, the actuator 40 is free to oscillate about its center of mass in its fundamental mode. In this fundamental mode, the amplitude of the displacement oscillations of the actuator 40 is substantially zero at an annular displacement node 42 located between the center of the driven end wall 22 and the side wall 18. The amplitudes of the displacement oscillations at other points on the end wall 22 are greater than zero as represented by the vertical arrows. A central displacement anti-node 43 exists near the center of the actuator 40 and a peripheral displacement anti-node 43' exists near the perimeter of the actuator 40. The central displacement anti-node 43 is represented by the dashed curve after one half-cycle.

Figure 3B:
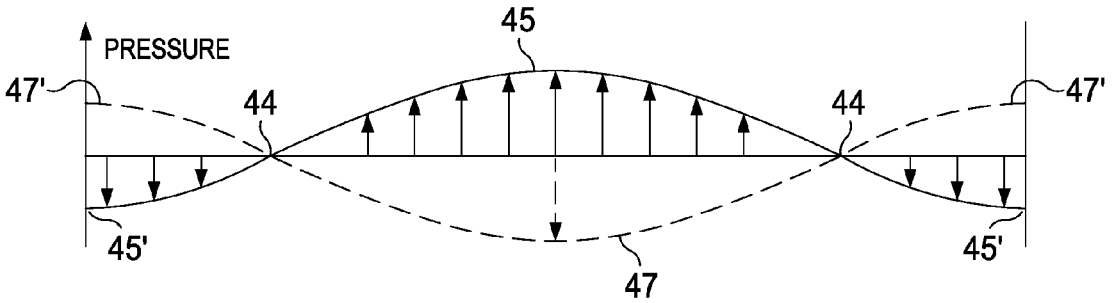
FIG. 3B shows a graph of the pressure oscillations of fluid within the cavity of the disc pump of FIG. 1 in response to the bending mode shown in FIG. 3A.

FIG. 3B shows one possible pressure oscillation profile illustrating the pressure oscillation within the cavity 16 resulting from the axial displacement oscillations shown in FIG. 3A. The solid curved line and arrows represent the pressure at one point in time. In this mode and higher-order modes, the amplitude of the pressure oscillations has a peripheral pressure anti-node 45' near the side wall 18 of the cavity 16. The amplitude of the pressure oscillations is substantially zero at the annular pressure node 44 between the central pressure anti-node 45 and the peripheral pressure anti-node 45'. At the same time, the amplitude of the pressure oscillations as represented by the dashed line that has a negative central pressure anti-node 47 near the center of the cavity 16 with a peripheral pressure anti-node 47' and the same annular pressure node 44. For a cylindrical cavity, the radial dependence of the amplitude of the pressure oscillations in the cavity 16 may be approximated by a Bessel function of the first kind. The pressure oscillations described above result from the radial movement of the fluid in the cavity 16 and so will be referred to as the "radial pressure oscillations" of the fluid within the cavity 16 as distinguished from the axial displacement oscillations of the actuator 40.

With further reference to FIGS. 3A and 3B, it can be seen that the radial dependence of the amplitude of the axial displacement oscillations of the actuator 40 (the "mode-shape" of the actuator 40) should approximate a Bessel function of the first kind so as to match more closely the radial dependence of the amplitude of the desired pressure oscillations in the cavity 16 (the "mode-shape" of the pressure oscillation). By not rigidly mounting the actuator 40 at its perimeter and allowing it to vibrate more freely about its center of mass, the mode-shape of the displacement oscillations substantially matches the mode-shape of the pressure oscillations in the cavity 16, thus achieving mode-shape matching or, more simply, mode-matching. Although the mode-matching may not always be perfect in this respect, the axial displacement oscillations of the actuator 40 and the corresponding pressure oscillations in the cavity 16 have substantially the same relative phase across the full surface of the actuator 40, wherein the radial position of the annular pressure node 44 of the pressure oscillations in the cavity 16 and the radial position of the annular displacement node 42 of the axial displacement oscillations of actuator 40 are substantially coincident.

As the actuator 40 vibrates about its center of mass, the radial position of the annular displacement node 42 will necessarily lie inside the radius of the actuator 40 when the actuator 40 vibrates in its fundamental bending mode as illustrated in FIG. 3A. Thus, to ensure that the annular displacement node 42 is coincident with the annular pressure node 44, the radius of the actuator ($r_{act}$) should preferably be greater than the radius of the annular pressure node 44 to optimize mode-matching. Assuming again that the pressure oscillation in the cavity 16 approximates a Bessel function of the first kind, the radius of the annular pressure node 44 would be approximately 0.63 of the radius from the center of the end wall 22 to the side wall 18, i.e., the radius of the cavity 16 ("r"), as shown in FIG. 2A. Therefore, the radius of the actuator 40 ($r_{act}$) should preferably satisfy the following inequality: $r_{act} \geq 0.63\ r$.

The ring-shaped isolator 30 may be a flexible membrane, which enables the edge of the actuator 40 to move more freely as described above by bending and stretching in response to the vibration of the actuator 40 as shown by the displacement at the peripheral displacement anti-node 43' in FIG. 3A. The isolator 30 overcomes the potential damping effects of the side wall 18 on the actuator 40 by providing a low mechanical impedance support between the actuator 40 and the cylindrical wall 11 of the disc pump 10, thereby reducing the damping of the axial oscillations at the peripheral displacement anti-node 43' of the actuator 40. Essentially, the isolator 30 minimizes the energy being transferred from the actuator 40 to the side wall 18 with the outer peripheral edge of the isolator 30 remaining substantially stationary. Consequently, the annular displacement node 42 will remain substantially aligned with the annular pressure node 44 so as to maintain the mode-matching condition of the disc pump 10. Thus, the axial displacement oscillations of the driven end wall 22 continue to efficiently generate oscillations of the pressure within the cavity 16 from the central pressure anti-nodes 45, 47 to the peripheral pressure anti-nodes 45', 47' at the side wall 18 as shown in FIG. 3B.

Figure 4:
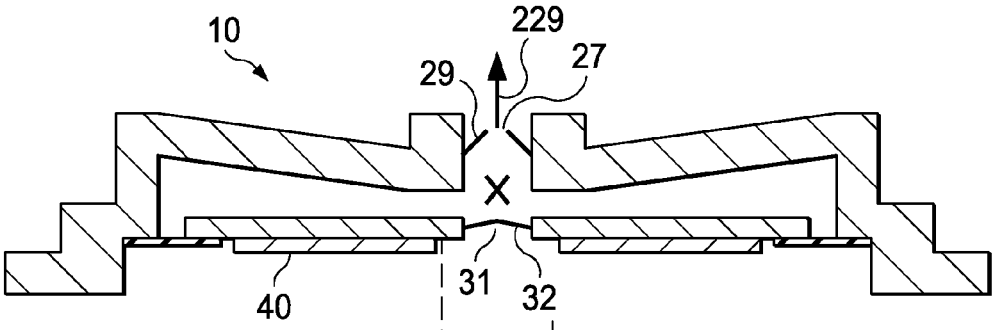
FIG. 4 shows a cross-section view of the disc pump of FIG. 1, wherein the two valves are represented by a single valve illustrated in FIGS. 7A-7D.
Figure 5:
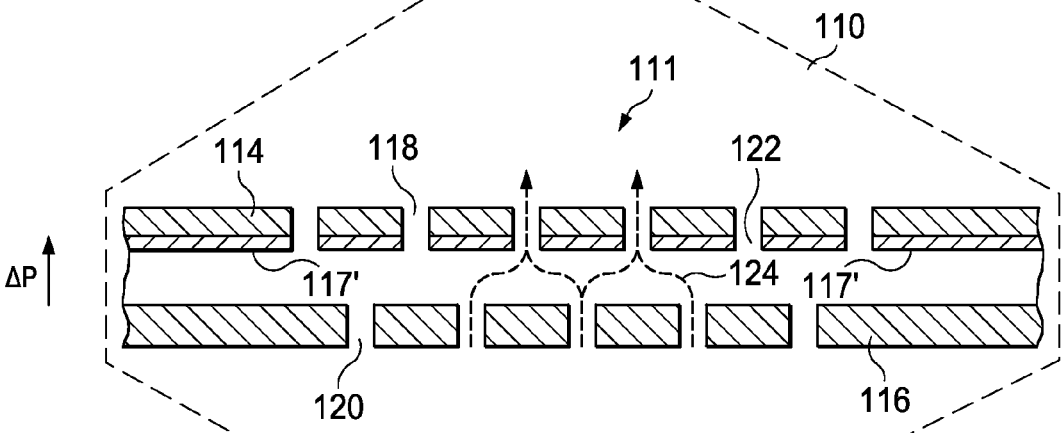
FIG. 5 shows a cross-sectional, detail view of a center portion of the valve of FIGS. 7A-7D.
Figure 6:
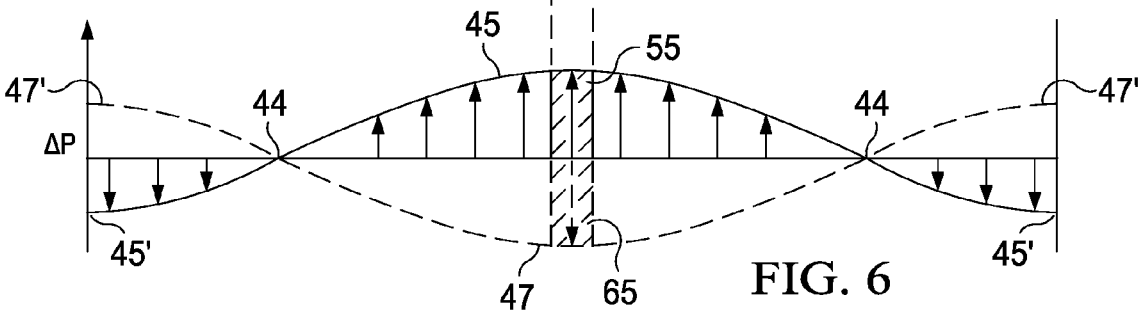
FIG. 6 shows a graph of pressure oscillations of fluid within the cavity of the disc pump of FIG. 4 to illustrate the pressure differential applied across the valve of FIG. 5, as indicated by the dashed lines.

Referring to FIG. 4, the disc pump 10 of FIG. 2A is shown with the valves 29, 32, both of which are substantially similar in structure as represented, for example, by a valve 110 shown in FIGS. 7A-7D and having a center portion 111 shown in FIG. 5. The following description associated with FIGS. 4-9 are all based on the function of a single valve 110 that may be positioned in any one of the apertures 27, 31 of the disc pump 10. FIG. 6 shows a graph of the pressure oscillations of fluid within the disc pump 10 as shown in FIG. 3B. The valve 110 allows fluid to flow in only one direction as described above. The valve 110 may be a check valve or any other valve that allows fluid to flow in only one direction. Some valve types may regulate fluid flow by switching between an open and closed position. For such valves to operate at the high frequencies generated by the actuator 40, the valves 29, 32 have an extremely fast response time such that they are able to open and close on a timescale significantly shorter than the timescale of the pressure variation. One embodiment of the valves 29, 32 achieves this by employing an extremely light flap valve, which has low inertia and consequently is able to move rapidly in response to changes in relative pressure across the valve structure.

Referring to FIGS. 7A-D and 5, valve 110 is such a flap valve for the disc pump 10 according to an illustrative embodiment. The valve 110 comprises a substantially cylindrical wall 112 that is ring-shaped and closed at one end by a retention plate 114 and at the other end by a sealing plate 116. The inside surface of the wall 112, the retention plate 114, and the sealing plate 116 form a cavity 115 within the valve 110. The valve 110 further comprises a substantially circular flap 117 disposed between the retention plate 114 and the sealing plate 116, but adjacent the sealing plate 116. The circular flap 117 may be disposed adjacent the retention plate 114 in an alternative embodiment as will be described in more detail below, and in this sense the flap 117 is considered to be "biased" against either one of the sealing plate 116 or the retention plate 114. The peripheral portion of the flap 117 is sandwiched between the sealing plate 116 and the ring-shaped wall 112 so that the motion of the flap 117 is restrained in the plane substantially perpendicular the surface of the flap 117. The motion of the flap 117 in such plane may also be restrained by the peripheral portion of the flap 117 being attached directly to either the sealing plate 116 or the wall 112, or by the flap 117 being a close fit within the ring-shaped wall 112, in an alternative embodiment. The remainder of the flap 117 is sufficiently flexible and movable in a direction substantially perpendicular to the surface of the flap 117, so that a force applied to either surface of the flap 117 will motivate the flap 117 between the sealing plate 116 and the retention plate 114.

The retention plate 114 and the sealing plate 116 both have holes 118 and 120, respectively, which extend through each plate. The flap 117 also has holes 122 that are generally aligned with the holes 118 of the retention plate 114 to provide a passage through which fluid may flow as indicated by the dashed arrows 124 in FIGS. 5 and 8A. The holes 122 in the flap 117 may also be partially aligned, i.e., having only a partial overlap, with the holes 118 in the retention plate 114. Although the holes 118, 120, 122 are shown to be of substantially uniform size and shape, they may be of different diameters or even different shapes without limiting the scope of the invention. In one embodiment of the invention, the holes 118 and 120 form an alternating pattern across the surface of the plates as shown by the solid and dashed circles, respectively, in FIG. 7D. In other embodiments, the holes 118, 120, 122 may be arranged in different patterns without affecting the operation of the valve 110 with respect to the functioning of the individual pairings of holes 118, 120, 122 as illustrated by individual sets of the dashed arrows 124. The pattern of holes 118, 120, 122 may be designed to increase or decrease the number of holes to control the total flow of fluid through the valve 110 as necessary. For example, the number of holes 118, 120, 122 may be increased to reduce the flow resistance of the valve 110 to increase the total flow rate of the valve 110.

Figure 7A:
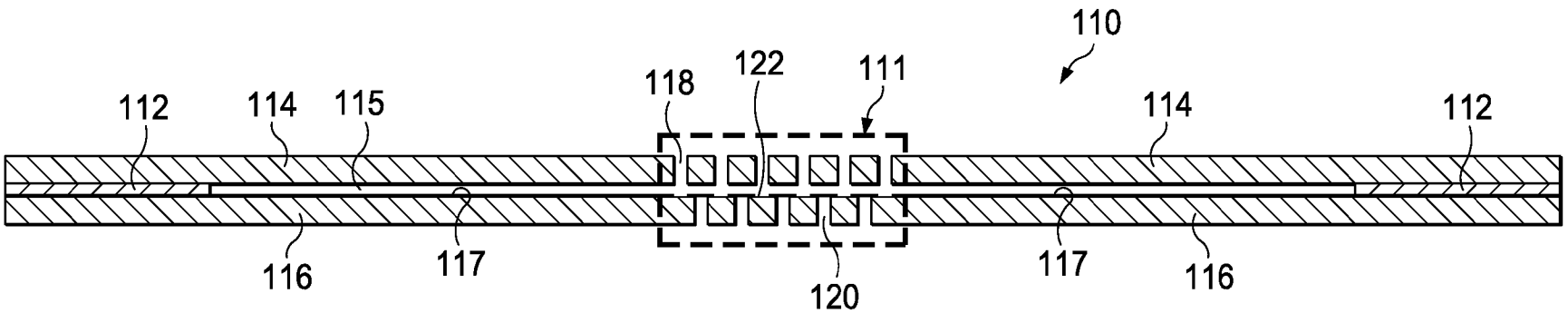
FIG. 7A shows a cross-section view of an illustrative embodiment of a valve in a closed position.
Figure 7B:
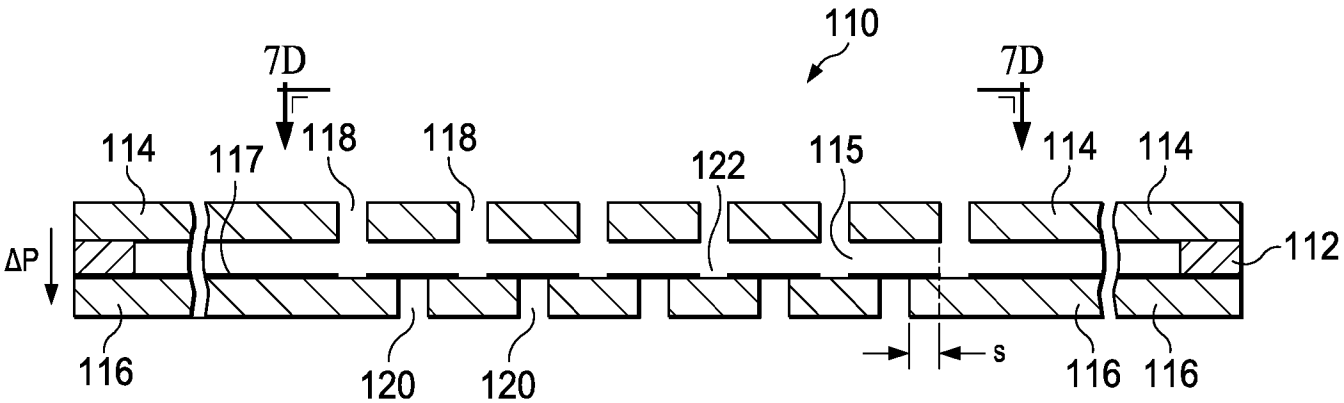
FIG. 7B shows a detail, sectional view of the valve of FIG. 7A taken along line 7B-7B, which is shown in FIG. 7D.
Figure 7C:
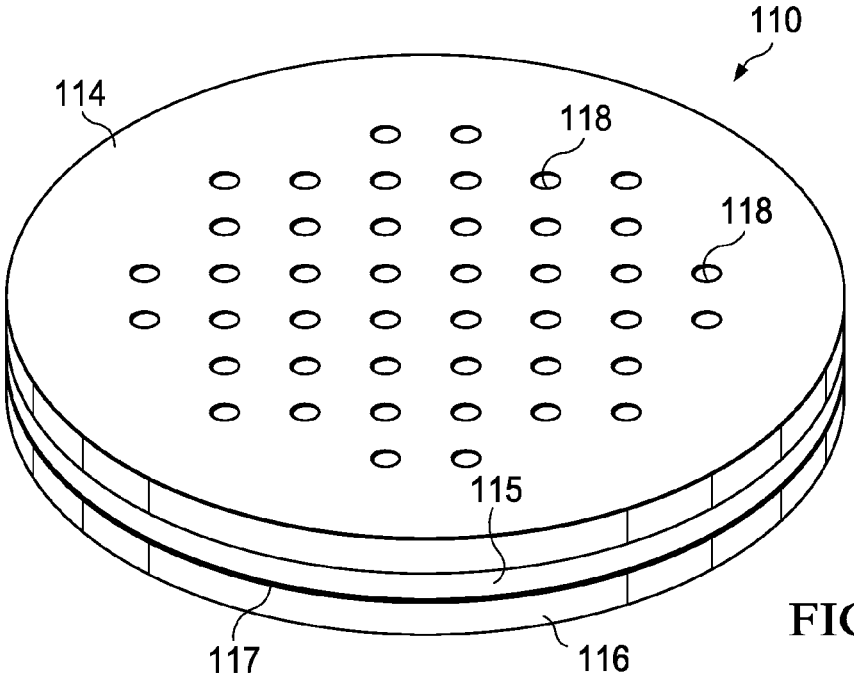
FIG. 7C shows a perspective view of the valve of FIG. 7A.
Figure 7D:
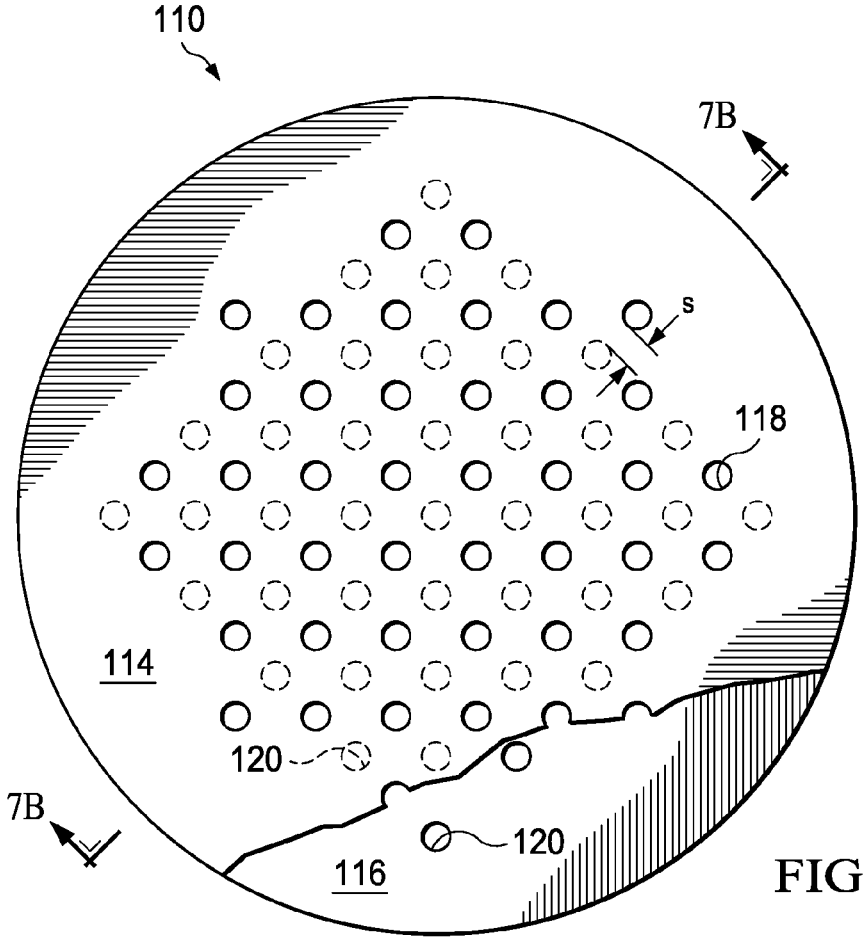
FIG. 7D shows a top view of the valve of FIG. 7A.
Figure 8A:
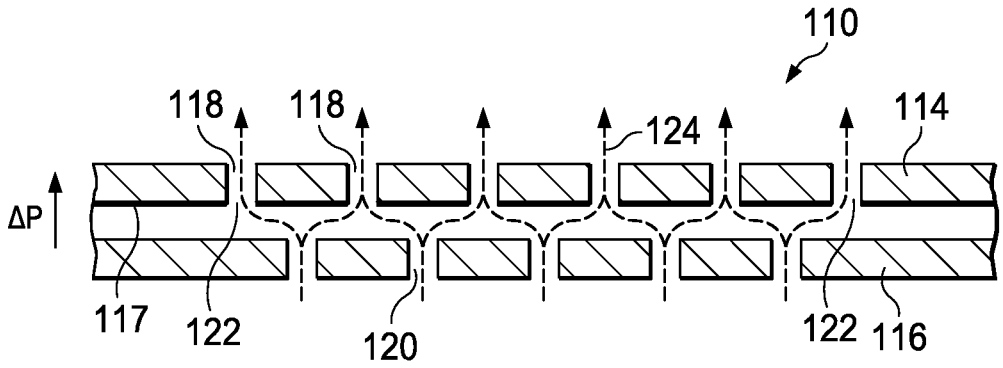
FIG. 8A shows a cross-section view of the valve of FIG. 7A in an open position when fluid flows through the valve.
Figure 8B:
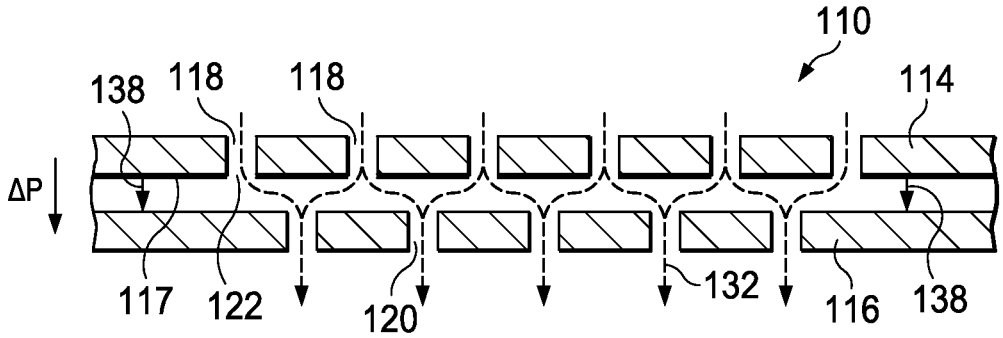
FIG. 8B shows a cross-section view of the valve in FIG. 7A in transition between the open and closed positions before closing.
Figure 8C:
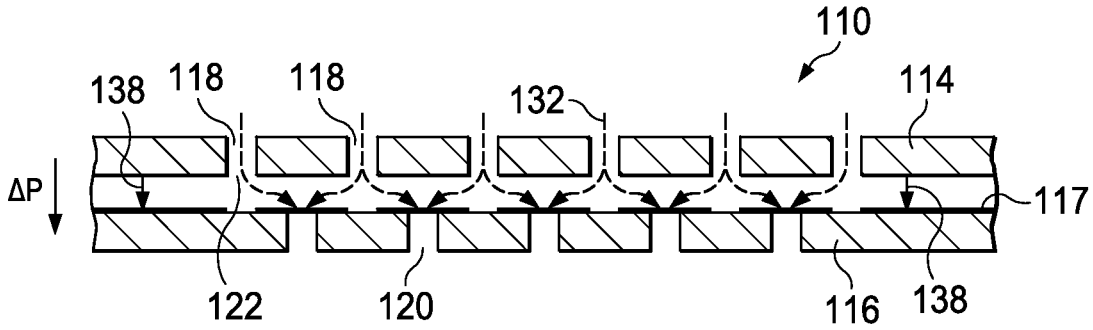
FIG. 8C shows a cross-section view of the valve of FIG. 7A in a closed position when fluid flow is blocked by a valve flap.

Referring also to FIGS. 8A-8C, the center portion 111 of the valve 110 illustrates how the flap 117 is motivated between the sealing plate 116 and the retention plate 114 when a force is applied to either surface of the flap 117. When no force is applied to either surface of the flap 117 to overcome the bias of the flap 117, the valve 110 is in a "normally closed" position because the flap 117 is disposed adjacent the sealing plate 116 where the holes 122 of the flap are offset or not aligned with the holes 118 of the sealing plate 116. In this "normally closed" position, the flow of fluid through the sealing plate 116 is substantially blocked or covered by the non-perforated portions of the flap 117 as shown in FIGS. 7A and 7B. When pressure is applied against either side of the flap 117 that overcomes the bias of the flap 117 and motivates the flap 117 away from the sealing plate 116 towards the retention plate 114 as shown in FIGS. 5 and 8A, the valve 110 moves from the normally closed position to an "open" position over a time period, i.e., an opening time delay ($T_o$), allowing fluid to flow in the direction indicated by the dashed arrows 124. When the pressure changes direction as shown in FIG. 8B, the flap 117 will be motivated back towards the sealing plate 116 to the normally closed position. When this happens, fluid will flow for a short time period, i.e., a closing time delay ($T_c$), in the opposite direction as indicated by the dashed arrows 132 until the flap 117 seals the holes 120 of the sealing plate 116 to substantially block fluid flow through the sealing plate 116 as shown in FIG. 8C. In other embodiments of the invention, the flap 117 may be biased against the retention plate 114 with the holes 118, 122 aligned in a "normally open" position. In this embodiment, applying positive pressure against the flap 117 will be necessary to motivate the flap 117 into a "closed" position. Note that the terms "sealed" and "blocked" as used herein in relation to valve operation are intended to include cases in which substantial (but incomplete) sealing or blockage occurs, such that the flow resistance of the valve is greater in the "closed" position than in the "open" position.

Unless the flap 117 is actively driven by another mechanism, the operation of the valve 110 is a function of the change in direction of the differential pressure ($\Delta P$) of the fluid across the valve 110. In FIG. 8B, the differential pressure has been assigned a negative value ($-\Delta P$) as indicated by the downward pointing arrow. When the differential pressure has a negative value ($-\Delta P$), the fluid pressure at the outside surface of the retention plate 114 is greater than the fluid pressure at the outside surface of the sealing plate 116. This negative differential pressure ($-\Delta P$) drives the flap 117 into the fully closed position, wherein the flap 117 is pressed against the sealing plate 116 to block the holes 120 in the sealing plate 116, thereby substantially preventing the flow of fluid through the valve 110. When the differential pressure across the valve 110 reverses to become a positive differential pressure ($+\Delta P$) as indicated by the upward pointing arrow in FIG. 8A, the flap 117 is motivated away from the sealing plate 116 and towards the retention plate 114 into the open position. When the differential pressure has a positive value ($+\Delta P$), the fluid pressure at the outside surface of the sealing plate 116 is greater than the fluid pressure at the outside surface of the retention plate 114. In the open position, the movement of the flap 117 unblocks the holes 120 of the sealing plate 116 so that fluid is able to flow through them and the aligned holes 122 and 118 of the flap 117 and the retention plate 114, respectively, as indicated by the dashed arrows 124.

When the differential pressure across the valve 110 changes from a positive differential pressure ($+\Delta P$) back to a negative differential pressure ($-\Delta P$) as indicated by the downward pointing arrow in FIG. 8B, fluid begins flowing in the opposite direction through the valve 110 as indicated by the dashed arrows 132, which forces the flap 117 back toward the closed position shown in FIG. 8C. In FIG. 8B, the fluid pressure between the flap 117 and the sealing plate 116 is lower than the fluid pressure between the flap 117 and the retention plate 114. Thus, the flap 117 experiences a net force, represented by arrows 138, which accelerates the flap 117 toward the sealing plate 116 to close the valve 110. In this manner, the changing differential pressure cycles the valve 110 between closed and open positions based on the direction (i.e., positive or negative) of the differential pressure across the valve 110. It should be understood that the flap 117 could be biased against the retention plate 114 in an open position when no differential pressure is applied across the valve 110, i.e., the valve 110 would then be in a "normally open" position.

When the differential pressure across the valve 110 reverses to become a positive differential pressure (+ΔP) as shown in FIGS. 5 and 8A, the biased flap 117 is motivated away from the sealing plate 116 against the retention plate 114 into the open position. In this position, the movement of the flap 117 unblocks the holes 120 of the sealing plate 116 so that fluid is permitted to flow through them and the aligned holes 118 of the retention plate 114 and the holes 122 of the flap 117 as indicated by the dashed arrows 124. When the differential pressure changes from the positive differential pressure (+ΔP) back to the negative differential pressure (−ΔP), fluid begins to flow in the opposite direction through the valve 110 (see FIG. 8B), which forces the flap 117 back toward the closed position (see FIG. 8C). Thus, as the pressure oscillations in the cavity 16 cycle the valve 110 between the normally closed position and the open position, the disc pump 10 provides reduced pressure every half cycle when the valve 110 is in the open position.

As indicated above, the operation of the valve 110 may be a function of the change in direction of the differential pressure (ΔP) of the fluid across the valve 110. The differential pressure (ΔP) is assumed to be substantially uniform across the entire surface of the retention plate 114 because (1) the diameter of the retention plate 114 is small relative to the wavelength of the pressure oscillations in the cavity 115, and (2) the valve 110 is located near the center of the cavity 16 where the amplitude of the positive central pressure anti-node 45 is relatively constant as indicated by the positive square-shaped portion 55 of the positive central pressure anti-node 45 and the negative square-shaped portion 65 of the negative central pressure anti-node 47 shown in FIG. 6. Therefore, there is virtually no spatial variation in the pressure across the center portion 111 of the valve 110.

Figures 9A, 9B:
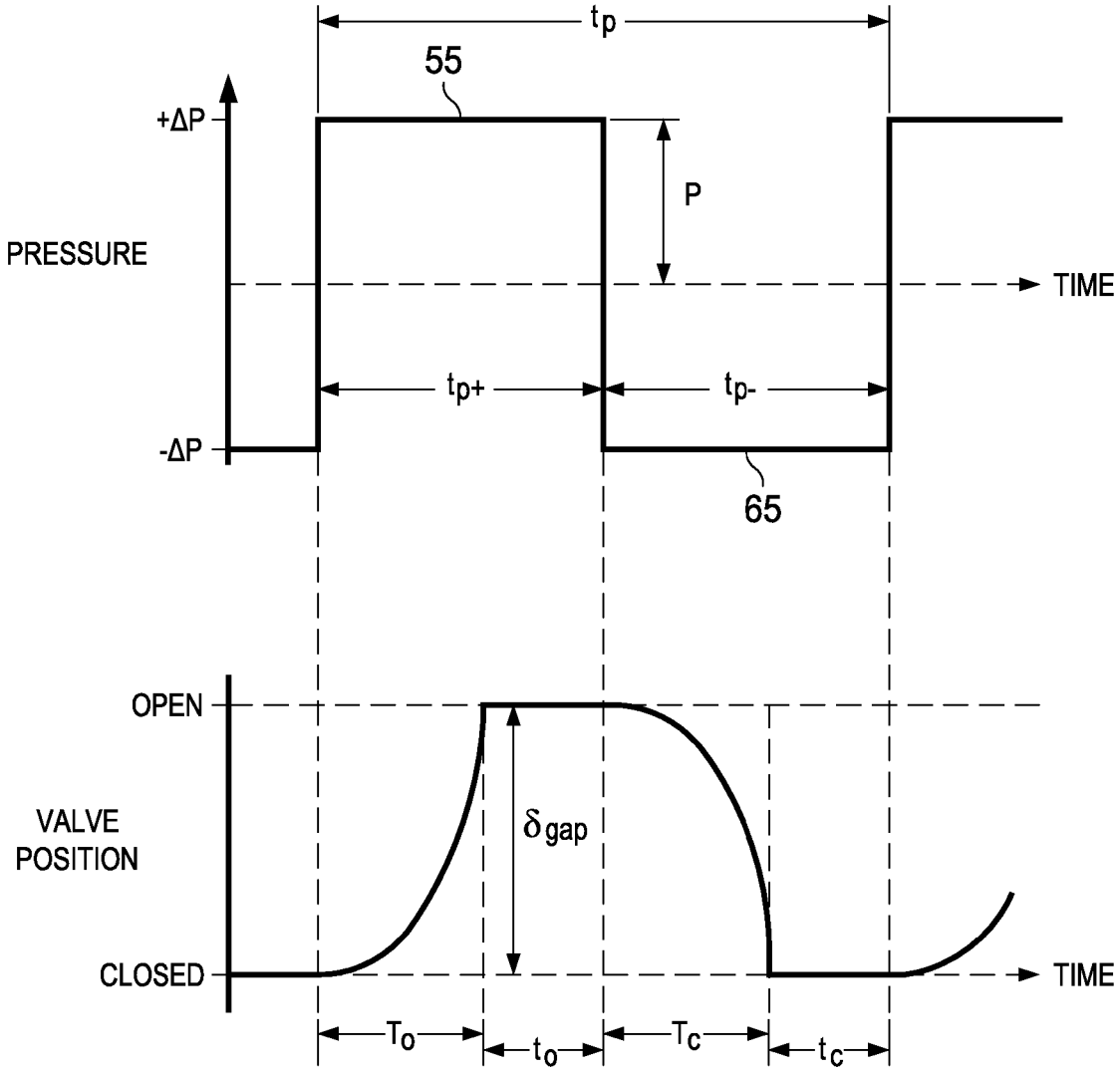
FIG. 9A shows a pressure graph of an oscillating differential pressure applied across the valve of FIG. 5 according to an illustrative embodiment.
FIG. 9B shows a fluid-flow graph of an operating cycle of the valve of FIG. 5 between an open and closed position.

FIG. 9A further illustrates the dynamic operation of the valve 110 when it is subject to a differential pressure, which varies in time between a positive value (+ΔP) and a negative value (−ΔP). While in practice the time-dependence of the differential pressure across the valve 110 may be approximately sinusoidal, the time-dependence of the differential pressure across the valve 110 is approximated as varying in the square-wave form shown in FIG. 9A to facilitate explanation of the operation of the valve 110. The positive differential pressure 55 is applied across the valve 110 over the positive pressure time period ($t_{p+}$) and the negative differential pressure 65 is applied across the valve 110 over the negative pressure time period ($t_{p-}$) of the square wave. FIG. 9B illustrates the motion of the flap 117 in response to this time-varying pressure. As differential pressure (ΔP) switches from negative 65 to positive 55, the valve 110 begins to open and continues to open over an opening time delay ($T_o$) until the valve flap 117 meets the retention plate 114 as also described above and as shown by the graph in FIG. 9B. As differential pressure (ΔP) subsequently switches back from positive differential pressure 55 to negative differential pressure 65, the valve 110 begins to close and continues to close over a closing time delay ($T_c$) as also described above and shown in FIG. 9B.

The retention plate 114 and the sealing plate 116 should be strong enough to withstand the fluid pressure oscillations to which they are subjected without significant mechanical deformation. The retention plate 114 and the sealing plate 116 may be formed from any suitable rigid material, such as glass, silicon, ceramic, or metal. The holes 118, 120 in the retention plate 114 and the sealing plate 116 may be formed by any suitable process including chemical etching, laser machining, mechanical drilling, powder blasting, and, stamping. In one embodiment, the retention plate 114 and the sealing plate 116 are formed from sheet steel between 100 and 200 microns thick, and the holes 118, 120 therein are formed by chemical etching. The flap 117 may be formed from any lightweight material, such as a metal or polymer film. In one embodiment, when fluid pressure oscillations of 20 kHz or greater are present on either the retention plate side or the sealing plate side of the valve 110, the flap 117 may be formed from a thin polymer sheet between 1 micron and 20 microns in thickness. For example, the flap 117 may be formed from polyethylene terephthalate (PET) or a liquid crystal polymer film approximately 3 microns in thickness.

Figure 10A:
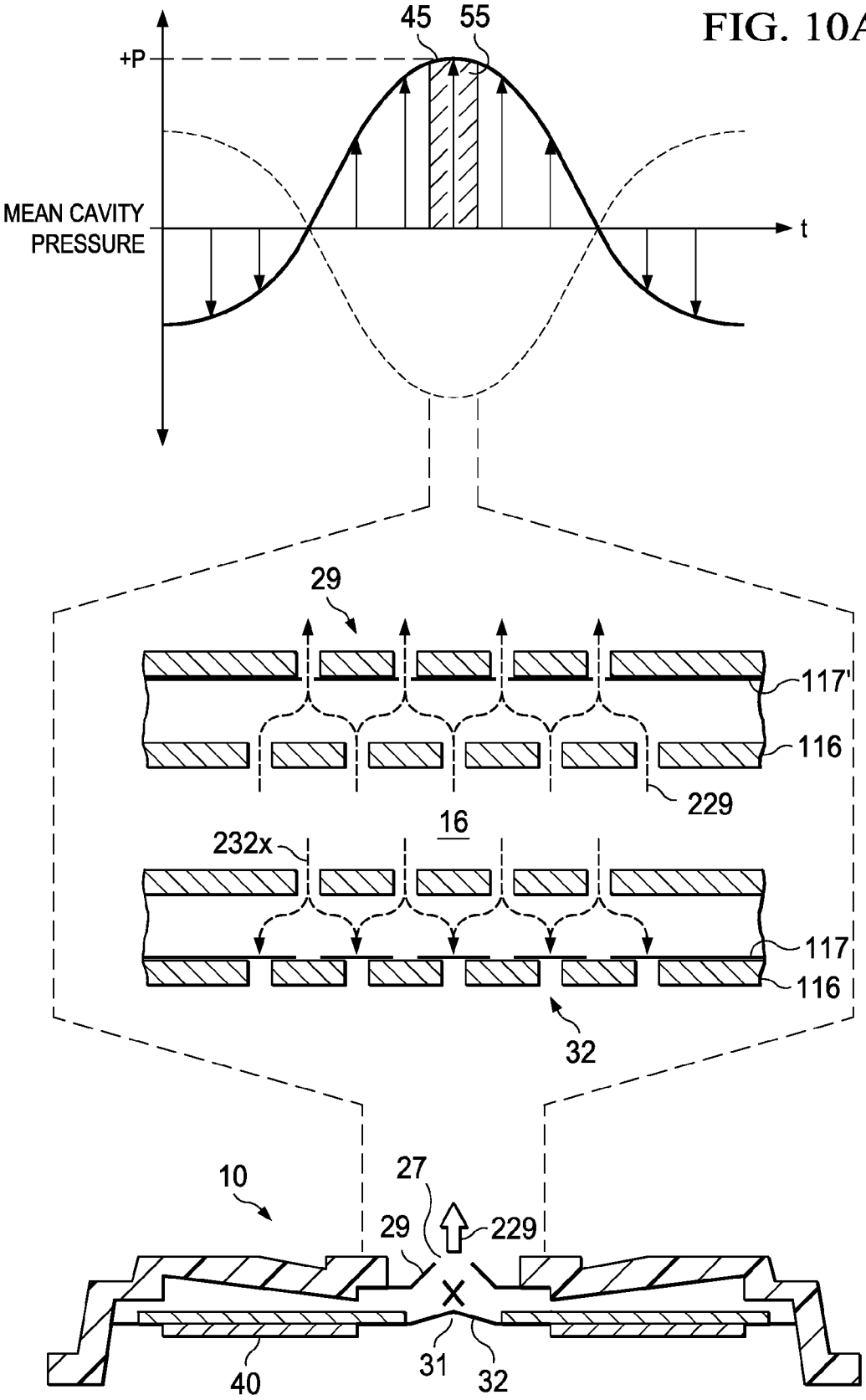
FIGS. 10A and 10B show a cross-section view of the disc pump of FIG. 4 including an exploded view of the center portion of the valves and a graph of the positive and negative portion of an oscillating pressure wave, respectively, being applied within a cavity.
Figure 10B:
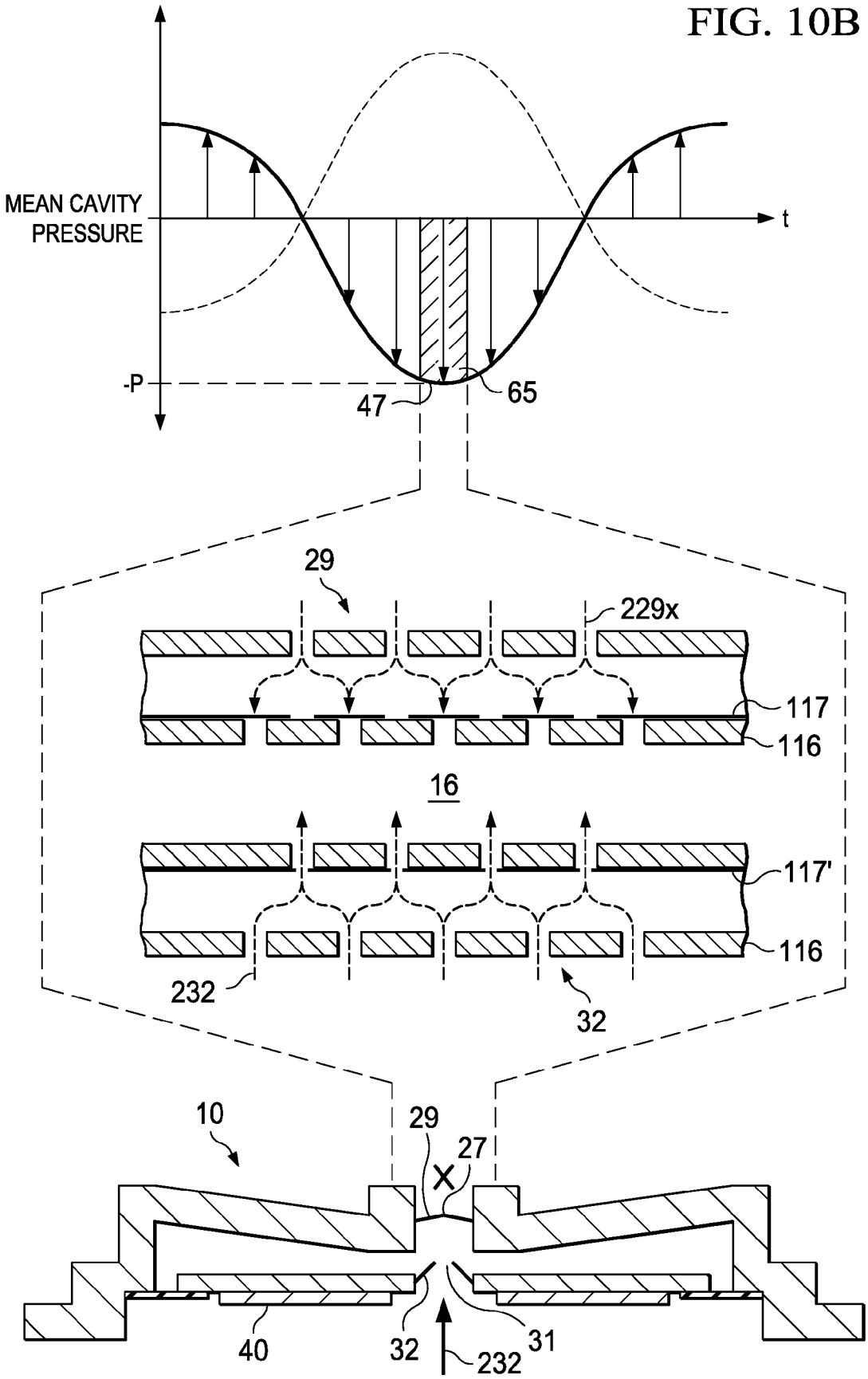

Referring now to FIGS. 10A and 10B, an exploded view of the two-valve disc pump 10 is shown that utilizes valve 110 as valves 29 and 32. In this embodiment the actuator valve 32 gates airflow 232 between the actuator aperture 31 and cavity 16 of the disc pump 10 (FIG. 10A), while end valve 29 gates airflow between the cavity 16 and the outlet aperture 27 of the disc pump 10 (FIG. 10B). Each of the figures also shows the pressure generated in the cavity 16 as the actuator 40 oscillates. Both of the valves 29 and 32 are located near the center of the cavity 16 where the amplitudes of the positive and negative central pressure anti-nodes 45 and 47, respectively, are relatively constant as indicated by the positive and negative square-shaped portions 55 and 65, respectively, as described above. In this embodiment, the valves 29 and 32 are both biased in the closed position as shown by the flap 117 and operate as described above when the flap 117 is motivated to the open position as indicated by flap 117'. The figures also show an exploded view of the positive and negative square-shaped portions 55, 65 of the central pressure anti-nodes 45, 47 and their simultaneous impact on the operation of both valves 29, 32 and the corresponding airflow 229 and 232, respectively, generated through each one.

Figures 10A, 10B, 11, 11A, 11B:
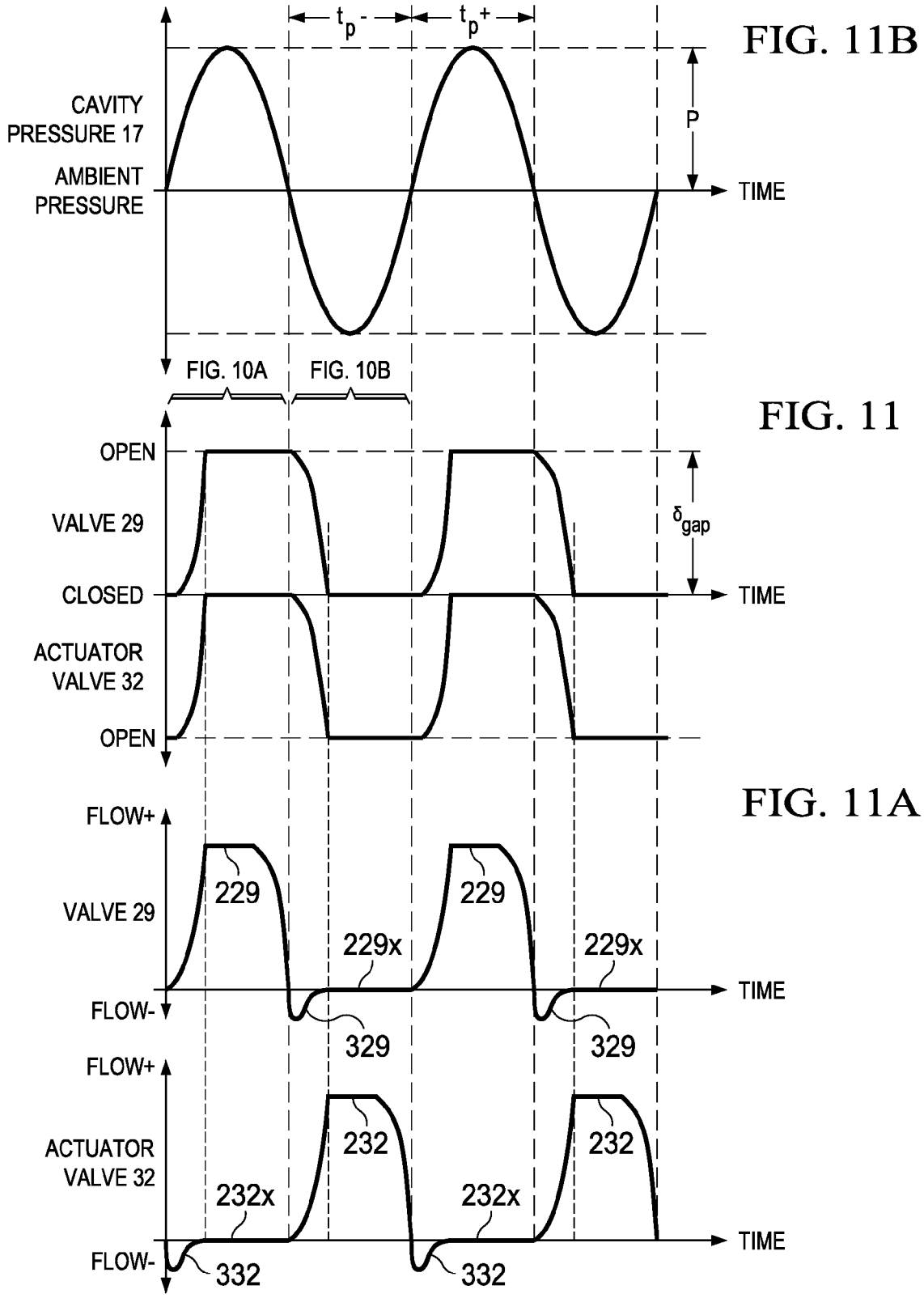
FIG. 11 shows the open and closed states of the valves of the disc pump of FIG. 4, and FIGS. 11A and 11B show the resulting flow and pressure characteristics, respectively, when the disc pump is in a free-flow mode.

Referring also to the relevant portions of FIGS. 11, 11A and 11B, the open and closed states of the valves 29 and 32 (FIG. 11) and the resulting flow characteristics of each one (FIG. 11A) are shown as related to the pressure in the cavity 16 (FIG. 11B). When the actuator aperture 31 and the outlet aperture 27 of the disc pump 10 are both at ambient pressure and the actuator 40 begins vibrating to generate pressure oscillations within the cavity 16 as described above, air begins flowing alternately through the valves 29, 32, causing air to flow from the actuator aperture 31 to the outlet aperture 27 of the disc pump 10, i.e., the disc pump 10 begins operating in a "free-flow" mode. In one embodiment, the actuator aperture 31 of the disc pump 10 may be supplied with air at ambient pressure while the outlet aperture 27 of the disc pump 10 is pneumatically coupled to a load (not shown) that becomes pressurized through the action of the disc pump 10. In another embodiment, the actuator aperture 31 of the disc pump 10 may be pneumatically coupled to a load (not shown)

that becomes depressurized to generate a negative pressure in the load, such as a wound dressing, through the action of the disc pump 10.

Referring more specifically to FIG. 10A and the relevant portions of FIGS. 11, 11A and 11B, the square-shaped portion 55 of the positive central pressure anti-node 45 is generated within the cavity 16 by the vibration of the actuator 40 during one half of the disc pump cycle as described above. When the actuator aperture 31 and outlet aperture 27 of the disc pump 10 are both at ambient pressure, the square-shaped portion 55 of the positive central anti-node 45 creates a positive differential pressure across the end valve 29 and a negative differential pressure across the actuator valve 32. As a result, the actuator valve 32 begins closing and the end valve 29 begins opening so that the actuator valve 32 blocks the airflow 232*x* through the actuator aperture 31, while the end valve 29 opens to release air from within the cavity 16 allowing the airflow 229 to exit the cavity 16 through the outlet aperture 27. As the actuator valve 32 closes and the end valve 29 opens (FIG. 11), the airflow 229 at the outlet aperture 27 of the disc pump 10 increases to a maximum value dependent on the design characteristics of the end valve 29 (FIG. 11A). The opened end valve 29 allows airflow 229 to exit the disc pump cavity 16 (FIG. 11B) while the actuator valve 32 is closed. When the positive differential pressure across end valve 29 begins to decrease, the airflow 229 begins to drop until the differential pressure across the end valve 29 reaches zero. When the differential pressure across the end valve 29 falls below zero, the end valve 29 begins to close allowing some back-flow 329 of air through the end valve 29 until the end valve 29 is fully closed to block the airflow 229*x* as shown in FIG. 10B.

Referring more specifically to FIG. 10B and the relevant portions of FIGS. 11, 11A, and 11B, the square-shaped portion 65 of the negative central anti-node 47 is generated within the cavity 16 by the vibration of the actuator 40 during the second half of the disc pump cycle as described above. When the actuator aperture 31 and outlet aperture 27 of the disc pump 10 are both at ambient pressure, the square-shaped portion 65 of the negative central anti-node 47 creates a negative differential pressure across the end valve 29 and a positive differential pressure across the actuator valve 32. As a result, the actuator valve 32 begins opening and the end valve 29 begins closing so that the end valve 29 blocks the airflow 229*x* through the outlet aperture 27, while the actuator valve 32 opens allowing air to flow into the cavity 16 as shown by the airflow 232 through the actuator aperture 31. As the actuator valve 32 opens and the end valve 29 closes (FIG. 11), the airflow at the outlet aperture 27 of the disc pump 10 is substantially zero except for the small amount of backflow 329 as described above (FIG. 11A). The opened actuator valve 32 allows airflow 232 into the disc pump cavity 16 (FIG. 11B) while the end valve 29 is closed. When the positive pressure differential across the actuator valve 32 begins to decrease, the airflow 232 begins to drop until the differential pressure across the actuator valve 32 reaches zero. When the differential pressure across the actuator valve 32 rises above zero, the actuator valve 32 begins to close again allowing some back-flow 332 of air through the actuator valve 32 until the actuator valve 32 is fully closed to block the airflow 232*x* as shown in FIG. 10A. The cycle then repeats itself as described above with respect to FIG. 10A. Thus, as the actuator 40 of the disc pump 10 vibrates during the two half cycles described above with respect to FIGS. 10A and 10B, the differential pressures across valves 29 and 32 cause air to flow from the actuator aperture 31 to the outlet aperture 27 of the disc pump 10 as shown by the airflows 232, 229, respectively.

Figure 12:
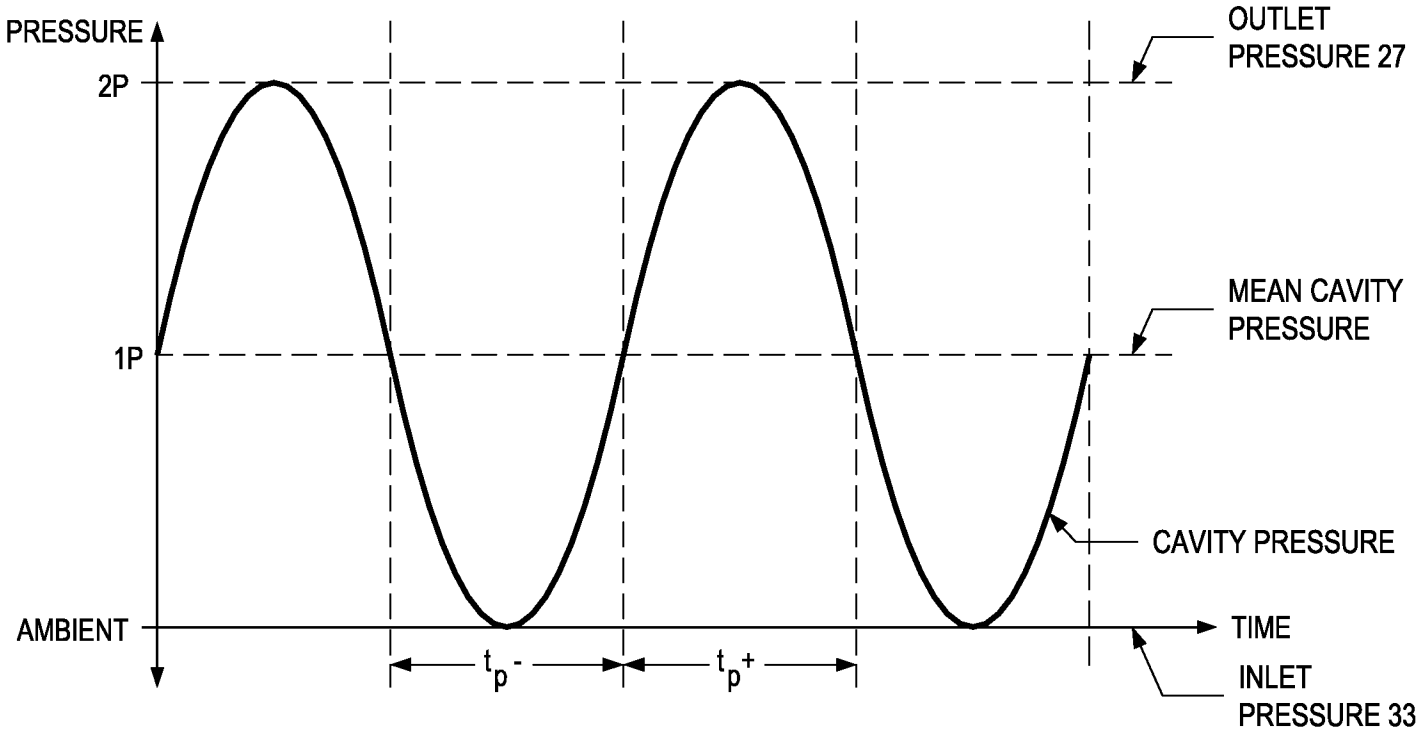
FIG. 12 shows a graph of the maximum differential pressure provided by the disc pump of FIG. 4 when the disc pump reaches the stall condition.

In the case where the actuator aperture 31 of the disc pump 10 is held at ambient pressure and the outlet aperture 27 of the disc pump 10 is pneumatically coupled to a load that becomes pressurized through the action of the disc pump 10, the pressure at the outlet aperture 27 of the disc pump 10 begins to increase until the outlet aperture 27 of the disc pump 10 reaches a maximum pressure at which time the airflow from the actuator aperture 31 to the outlet aperture 27 is negligible, i.e., the "stall" condition. FIG. 12 illustrates the pressures within the cavity 16 and outside the cavity 16 at the actuator aperture 31 and the outlet aperture 27 when the disc pump 10 is in the stall condition. More specifically, the mean pressure in the cavity 16 is approximately 1P above the inlet pressure (i.e. 1P above the ambient pressure) and the pressure at the center of the cavity 16 varies between approximately ambient pressure and approximately ambient pressure plus 2P. In the stall condition, there is no point in time at which the pressure oscillation in the cavity 16 results in a sufficient positive differential pressure across either inlet valve 32 or outlet valve 29 to significantly open either valve to allow any airflow through the disc pump 10. Because the disc pump 10 utilizes two valves, the synergistic action of the two valves 29, 32 described above is capable of increasing the differential pressure between the outlet aperture 27 and the actuator aperture 31 to a maximum differential pressure of 2P, double that of a single valve disc pump. Thus, under the conditions described in the previous paragraph, the outlet pressure of the two-valve disc pump 10 increases from ambient in the free-flow mode to a pressure of approximately ambient plus 2P when the disc pump 10 reaches the stall condition.

Figures 13A, 13B:
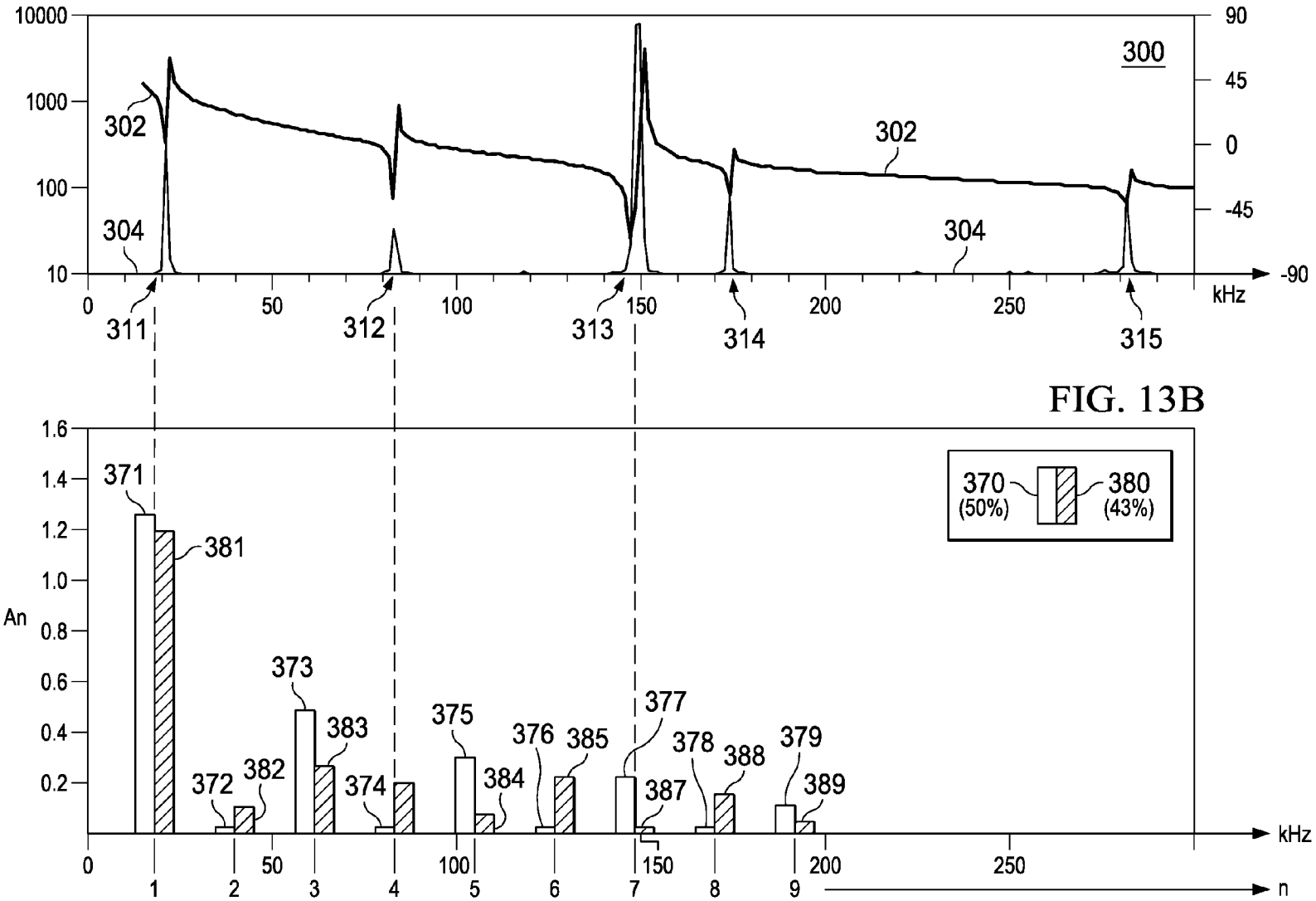
FIG. 13A is a graph of the impedance spectrum showing the resonant modes of the actuator of the pump of FIGS. 1-2B.
FIG. 13B is a graph of Fourier components of two square waves (having frequency duty cycles of 50% and 43% respectively) showing the harmonic content of these drive signals as a function of frequency.

To generate the displacement and pressure oscillations described above with regard to FIGS. 3A and 3B, the piezoelectric actuator 40 is driven at its fundamental resonant frequency. The actuator 40, however, has several modes of resonance. Referring to FIG. 13A, a graph of the impedance spectrum 300 of an illustrative piezoelectric actuator 40 is shown including both the magnitude component 302 and the phase component 304 of the impedance 300 as a function of frequency. The impedance spectrum 300 of the actuator 40 has peaks corresponding to the electro-mechanical resonant modes of the actuator 40 at specific frequencies including a fundamental mode of resonance 311 at about 21 kHz and higher frequency modes of resonance. Such higher frequency resonance modes include a second mode of resonance 312 at about 83 kHz, a third mode of resonance 313 at about 147 kHz, a fourth mode 314 of resonance at about 174 kHz, and a fifth mode of resonance 315 at about 282 kHz.

The fundamental mode of resonance 311 at about 21 KHz is the fundamental bending mode that creates the pressure oscillations in the cavity 16 to drive the disc pump 10 as described above. The second mode of resonance 312 at 83 kHz is a second bending mode that has a second annular displacement node (not shown) in addition to the single annular displacement node 44 of the fundamental mode 311. The fourth and fifth modes of resonance 314 and 315 at about 174 kHz and 282 kHz, respectively, are also higher order bending modes that are axially symmetric, having two and three additional annular displacement nodes (not shown), respectively, over and above the single annular displacement node 44 of the fundamental bending mode 311. As can be seen from FIG. 13A, the strength of these bending modes generally decreases with increasing frequency.

The third mode of resonance 313 of the actuator 40 is the fundamental breathing mode that causes the radial displacement of the actuator 40, as described above, without generating useful pressure oscillations within the cavity 16 of the disc pump 10. Essentially, the resonant in-plane motion of the actuator 40 dominates at this frequency, resulting in a very low impedance as can be seen in FIG. 13A. The low impedance of this fundamental breathing mode means that it draws high power when excited by a drive signal at that frequency.

A pulse-width modulated (PWM) square-wave signal comprising a fundamental frequency and harmonic frequencies of the fundamental frequency may be used to drive the actuator 40 described above. Referring to FIG. 13B, a bar graph of the Fourier components 370(*n*) representing the harmonics of the PWM square-wave signal indicated by the legend 370 are shown for driving the actuator 40 where "n" is the harmonic number. The Fourier component for each harmonic is listed in Table I with a separate reference number for each of the harmonic components of a PWM square-wave signal having different frequency duty cycles. The PWM square-wave signal 370 has a frequency duty cycle ("DC") of 50%. Frequency duty cycle means the percentage of a square-wave period that the signal is in one of its two states, e.g., a signal that is positive for 50% of the period of the square-wave has a frequency duty cycle of 50%. The amplitude of each odd harmonic component of a PWM square-wave signal with a 50% frequency duty cycle decreases inversely proportional to the harmonic number. The amplitude of each even harmonic of a PWM square-wave signal with a 50% frequency duty cycle is zero.

TABLE I

Harmonic Frequencies of PWM Drive Signal

| Harmonic (n) | kHz | DC = 50% 370 | DC = 43% 380 |
|---|---|---|---|
| Fundamental Frequency (1) | 20.9 | 371 | 381 |
| Second (2) | 41.8 | 372 | 382 |
| Third (3) | 62.7 | 373 | 383 |
| Fourth (4) | 83.6 | 374 | 384 |
| Fifth (5) | 104.5 | 375 | 385 |
| Sixth (6) | 125.4 | 376 | 386 |
| Seventh (7) | 146.3 | 377 | 387 |
| Eighth (8) | 167.2 | 378 | 388 |
| Ninth (9) | 188.1 | 379 | 389 |

In the example described above, the drive circuit is designed to drive the actuator in its fundamental bending mode, i.e. the frequency of the driving PWM square-wave signal is selected to match the frequency of the fundamental bending mode. However, as can be seen when comparing FIGS. 13A and 13B, certain harmonics of the PWM square-wave signal 370 may coincide with certain higher-order modes of resonance of the actuator 40. Where a harmonic of the drive signal coincides with a higher-order mode of the actuator 40, there is the potential for energy to be transferred into this mode, reducing the efficiency of the disc pump 10. It should be noted that the level of energy transferred into such a higher-order mode of resonance of the actuator 40 is dependent not only on the strength and type of that relevant mode and its corresponding impedance, but also on the amplitude of the drive signal exciting the actuator 40 at that particular harmonic frequency of the fundamental drive frequency. When the mode of resonance is both strong with a low impedance and driven by a significant drive signal amplitude, significant energy may be transferred into and dissipated by vibration of the actuator 40 in these undesirable higher-order modes, resulting in reduced pump efficiency. As such, the higher modes of resonance do not contribute to the useful operation of the disc pump 10, but rather waste the energy and adversely affect the efficiency of the disc pump 10.

More specifically, in the example of FIG. 13A, the seventh harmonic 377 of the 50% frequency duty cycle PWM square-wave signal 370 coincides with the low-impedance of the fundamental breathing mode 313 at about 147 kHz. Even though the amplitude of the seventh harmonic 377 has decreased inversely proportional to its harmonic number to a relatively small number, the impedance of the actuator 40 is so low at that frequency that even the relatively small amplitude of the seventh harmonic 377 is sufficient for significant energy to be drawn into the fundamental breathing mode 313. FIG. 14B shows that the power absorbed by the actuator 40 at this frequency is close to that absorbed at the fundamental bending mode frequency: a large fraction of the total input power is thereby wasted, dramatically reducing the efficiency of the disc pump 10 in operation.

This detrimental excitation of the higher order modes of resonance of the actuator 40 may be suppressed by a number of methods, including either reducing the strength of the mode of resonance or reducing the amplitude of the harmonic of the drive signal, which is closest in frequency to a particular mode of resonance of the actuator 40. An embodiment is directed to an apparatus and method for reducing the excitation of the higher modes of resonance by the harmonics of the drive signal by properly selecting and/or modifying the driving signal. For example, a sine wave drive signal avoids the problem because it does not excite any of the higher order modes of resonance of the actuator 40 in the first place, as there are no harmonic frequencies contained within a sine wave. However, piezoelectric drive circuits typically employ square-wave drive signals for actuators because the drive circuit electronics are lower cost and more compact, which is important for medical and other applications of the disc pump 10 described in this application. Therefore, a preferred strategy is to modify the square-wave drive signal 370 for the actuator 40 so as to avoid driving the actuator 40 at the frequency of its fundamental breathing mode 313 at 147 kHz by attenuating the seventh harmonic 377 of the drive signal. In this manner the fundamental breathing mode 313 no longer draws significant energy from the drive circuit, and the associated reduction in the efficiency of the disc pump 10 is avoided.

A first embodiment of the solution is to add an electrical filter in series with the actuator 40 to eliminate or attenuate the amplitude of the seventh harmonic 377 present in the square-wave drive signal. For example, a series inductor may be used as a low-pass filter to attenuate the high-frequency harmonics in the square-wave drive signal, effectively smoothing the square-wave output of the drive circuit. Such an inductor adds an impedance Z in series with the actuator, where $|Z|=2\pi fL$. Here f is the frequency in question, and L is the inductance of the inductor. For $|Z|$ to be greater than 300Ω at a frequency f=147 kHz, the inductor should have a value greater than 320 μH. Adding such an inductor thereby significantly increases the impedance of the actuator 40 at 147 kHz. Alternative low-pass filter configurations, including both analog and digital low-pass filters, may be utilized in accordance with the principles described herein. Alternative to a low-pass filter, such as a notch filter, may be used to block the signal of the seventh harmonic 377 without affecting the fundamental frequency or the other harmonic signals. The notch filter may include a parallel inductor and capacitor having values of 3.9 μH and 330 nF, respectively, to suppress the seventh harmonic 377 of the drive signal. Alternative notch filter configurations, including both analog and digital notch filters, may be utilized in accordance with the principles of the described embodiments.

In a second embodiment, the PWM square-wave drive signal 370 can be modified to reduce the amplitude of the seventh harmonic 377 by modifying the frequency duty cycle of the square-wave signal 370. A Fourier analysis of the square-wave signal 370 can be used to determine a frequency duty cycle that results in reduction or elimination of the amplitude of the seventh harmonic of the drive frequency as indicated by Equation 2.

$$A_n = \frac{2}{T}\int_0^T \mathrm{Sin}\left(2n\pi \cdot \frac{t}{T}\right) f(t)dt \qquad \text{[Equation 2]}$$

Here $A_n$ is the amplitude of the $n^{th}$ harmonic, t is time, and T is the period of the square wave. The function $f(t)$ represents the square wave signal 370, taking a value of −1 for the "negative" part of the square wave, and +1 for the "positive" part. The function $f(t)$ clearly changes as the frequency duty cycle is varied.

Solving Equation 2 for the optimal frequency duty cycle to eliminate the seventh harmonic (i.e. setting $A_n$=0 for n=7):

$$A_7 = \frac{2}{T}\int_0^{T_1} \mathrm{Sin}\left(14\pi \cdot \frac{t}{T}\right)dt - \frac{2}{T}\int_{T_1}^{T} \mathrm{Sin}\left(14\pi \cdot \frac{t}{T}\right)dt = 0 \qquad \text{[Equation 3]}$$

$$\therefore \mathrm{Cos}\left(7\pi\frac{T_1}{T}\right) = 1$$

In these equations $T_1$ is the time at which the square wave changes sign from positive to negative, i.e. $T_1/T$ represents the frequency duty cycle. There are an infinite number of solutions to this equation, but as we wish to maintain the square wave close to 50% frequency duty cycle in order to preserve the fundamental component, we select a solution closest to the condition that $T_1/T$ is ½, i.e.:

$$\frac{T_1}{T} = \frac{3}{7}$$

which corresponds to a frequency duty cycle of 42.9%. Thus, the seventh harmonic signal will be eliminated or significantly attenuated in the drive signal of the frequency duty cycle of the square-wave is adjusted to a specific value of about 42.9%.

Referring again to FIG. 13B, a bar graph of the Fourier components 380(*n*) representing the harmonics of the PWM square-wave signal indicated by the legend 380 also are shown and listed with reference numbers in TABLE I. The PWM square-wave signal 380 has a frequency duty cycle of about 43% which alters the relative amplitudes of the harmonic components 380(*n*) compared to those of the PWM square-wave signal 370 with a 50% frequency duty cycle without much change in the amplitude of the fundamental frequency 381. Although the amplitude of the seventh harmonic component 387 has been reduced to a negligible level as desired, the amplitude of the fourth harmonic component 384 increases from zero as a result of the frequency duty cycle change, and its frequency is close to that of the second bending mode 312 of the actuator 40 at 83 kHz. However, the impedance of the actuator 40 at the second bending mode resonance 312 is sufficiently high (unlike the impedance at the fundamental breathing mode 314) so that insignificant energy is transferred into this actuator mode, and the presence of the fourth harmonic does not, therefore, significantly affect the power consumption of the actuator 40 and, consequently, the efficiency of the disc pump 10. With the exception of the seventh harmonic component 387, the other harmonic components shown in FIG. 13B are not problematic because they do not coincide with, or are not close to, any of the bending or breathing modes of the actuator 40 shown in FIG. 13A.

The amplitude of the seventh harmonic component 387 at a 43% frequency duty cycle is now negligibly small, such that the impact of the low impedance of the fundamental breathing mode 312 of the actuator 40 is negligible. Consequently, the PWM square-wave signal 380 with a 43% frequency duty cycle does not significantly excite the fundamental breathing mode 312 of the actuator 40, i.e., negligible energy is transmitted into this mode, so that the efficiency of the disc pump 10 is not compromised by using a PWM square-wave signal as the input for the actuator 40.

Figure 14A:
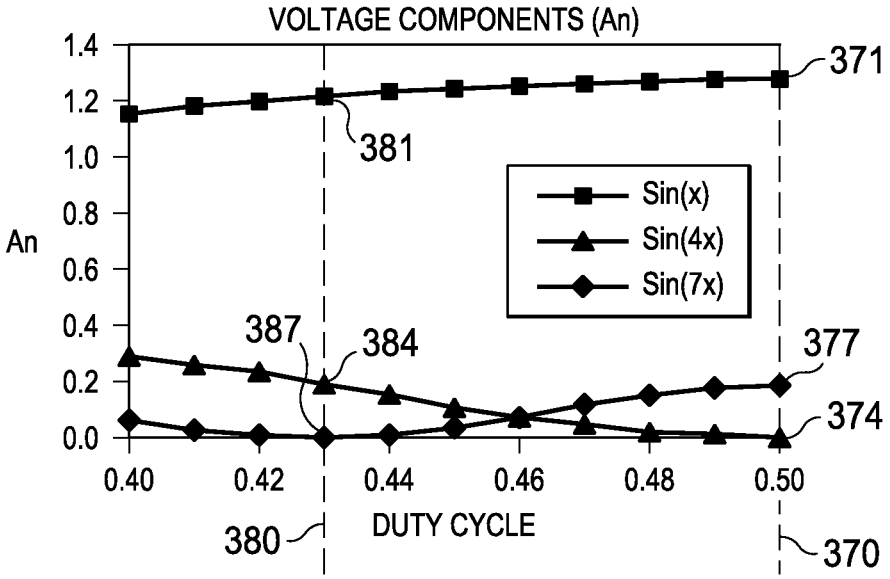
FIG. 14A shows a graph of the amplitude of certain harmonic frequency components and FIG. 14B shows a graph illustrating an example of the power dissipated by the actuator at these harmonic frequencies of the disc pump of FIGS. 1-2B as a function of the frequency duty cycle of the square-wave signal applied to the actuator.
Figure 14B:
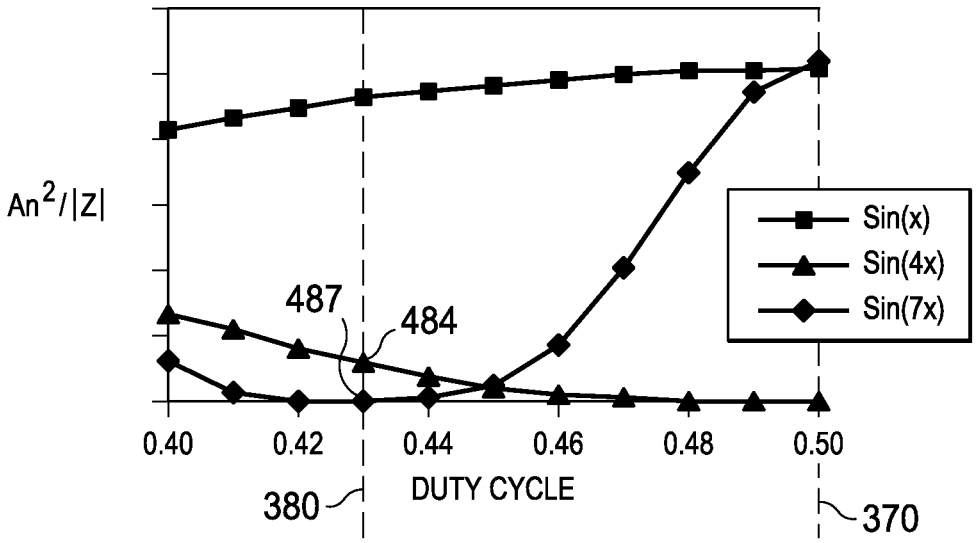

FIG. 14A shows graphs of harmonic amplitudes ($A_n$) for the fundamental frequency (labeled "sin (x)"), the fourth harmonic frequency ("sin (4x)"), and the seventh harmonic frequency ("sin (7x)") as the frequency duty cycle of the square-wave is varied. FIG. 14B shows the corresponding power consumption (proportional to $A_n^2/Z$, where Z is the impedance of the actuator at that frequency) of the actuator 40 as the frequency duty cycle of the square-wave is varied. More specifically, the fundamental frequencies 371 and 381 of the PWM square-wave signals 370 and 380, respectively, along with the corresponding amplitudes of their fourth and seventh harmonic components 374, 384 and 377, 387, respectively, described above in FIG. 13B, are shown as a function of frequency duty cycle. As can be seen in the Figures, the voltage amplitude of the seventh harmonic 387 for the PWM square-wave signal 380 having a 43% frequency duty cycle is equal to zero, while the voltage amplitude of the fundamental component 381 decreases only slightly from its value when the frequency duty cycle of the PWM square-wave signal 370 is 50%. It should be noted that the fourth harmonic 374 is not present in the PWM square-wave signal 380 having a 50% frequency duty cycle, but is present in the PWM square-wave signal 380 having a 43% frequency duty cycle as described above. The increase in the voltage amplitude for the fourth harmonic 384 is not problematic, however, because the corresponding impedance of the actuator 40 at the second mode of resonance 312 is relatively higher, as described above. Consequently, applying the voltage amplitude of the fourth harmonic causes very little power dissipation 484 in the actuator 40 as shown in FIG. 14B when the frequency duty cycle of the square-wave is 43%. The voltage amplitude of the seventh harmonic 387 has been substantially eliminated from the PWM square-wave signal 380 having a 43% frequency duty cycle and fundamentally negates the low impedance of the fundamental breathing mode 312 of the actuator 40 as indicated by the negligible power dissipation 487 in the actuator 40 as shown in FIG. 14B when the frequency duty cycle is 43%.

Figure 15:
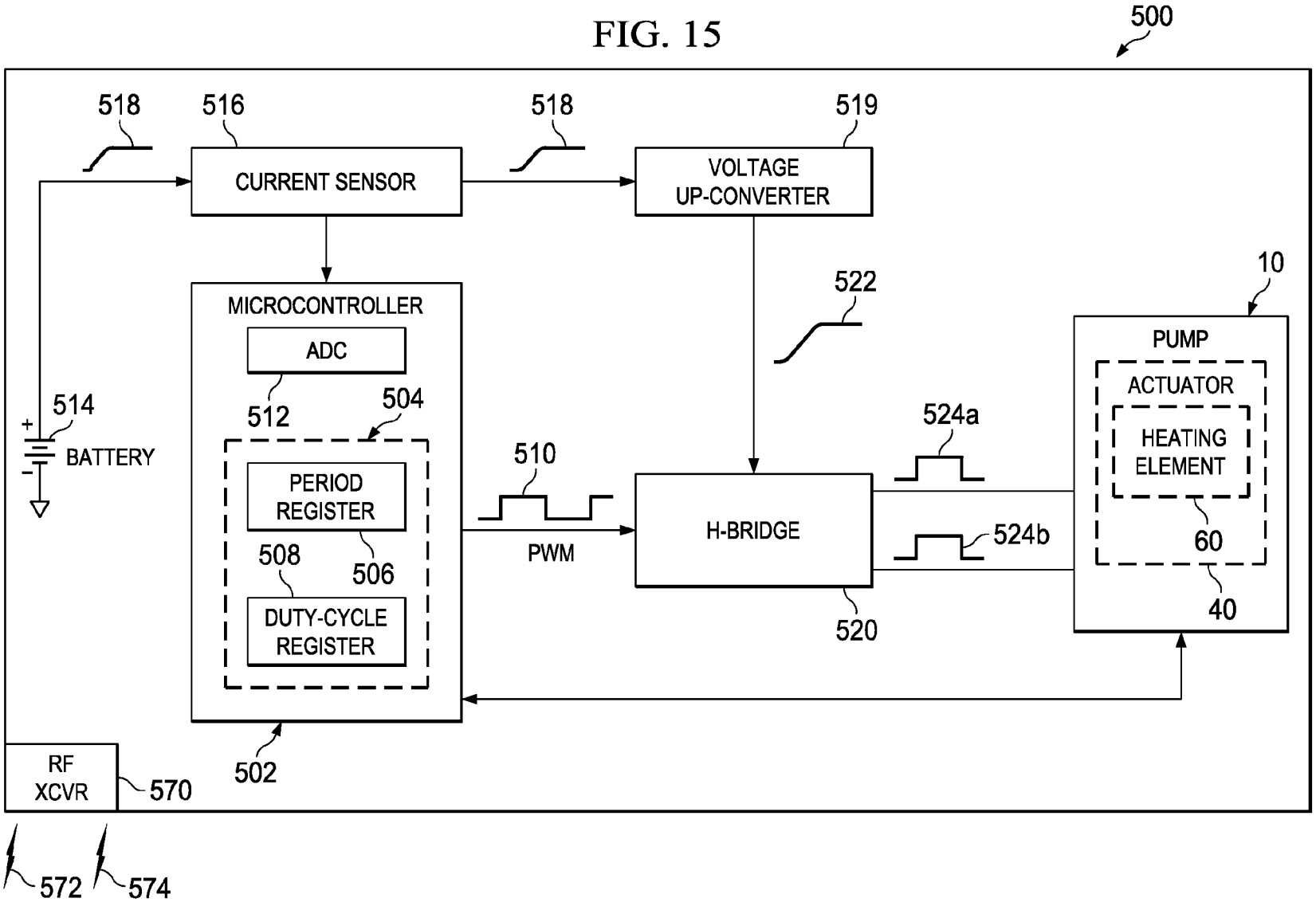
FIG. 15 shows a block diagram of a drive circuit for driving the disc pump shown in FIGS. 1-2B in accordance with an illustrative embodiment.

Referring now to FIG. 15, a drive circuit 500 for driving the disc pump 10 is shown in conjunction with a disc pump 10 that includes an actuator 40 having an integrated heating element 60. The drive circuit 500 may include a microcontroller 502 that is configured to generate a drive signal 510, which may be a PWM signal, as understood in the art. The microcontroller 502 may be configured with a memory 504 that stores data and/or software instructions that controls operation of the microcontroller 502. The memory 504 may include a period register 506 and a frequency duty cycle register 508. The period register 506 may be a memory location that stores a value that defines a period of the drive signal 510, and the frequency duty cycle register 508 may be a memory location that stores a value that defines a frequency duty cycle of the drive signal 510. In one embodiment, the values stored in the period register 506 and frequency duty cycle register are determined prior to execution of software by the microcontroller 502 and stored in the registers 506 and 508 by a user. The software (not shown) being executed by the microcontroller 502 may access the values stored in the registers 506 and 508 for use in establishing a period and frequency duty cycle for the drive signal 510. The microcontroller 502 may further include an analog-to-digital controller (ADC) 512 that is configured to convert analog signals into digital signals for use by the microcontroller 502 in generating, modifying, or otherwise controlling the drive signal 510.

The drive circuit 500 may further include a battery 514 that powers electronic components in the drive circuit 500 with a voltage signal 518. A current sensor 516 may be configured to sense current being drawn by the disc pump 10. A voltage up-converter 519 may be configured to up-convert, amplify, or otherwise increase the voltage signal 518 to an up converted voltage signal 522. An H-bridge 520 may be in communication with the voltage up converter 519 and the microcontroller 502, and be configured to drive the disc pump 10 with the pump drive signals 524*a* and 524*b* (collectively 524) that are applied to the actuator 40 of the disc pump 10. The H-bridge 520 may be a standard H-bridge, as understood in the art. In operation, if the current sensor 516 senses that the disc pump 10 is drawing too much current, as determined by the microcontroller 502 via the ADC 512, the microcontroller 502 may turn off the drive signal 510, thereby preventing the disc pump 10 or the drive circuit 500 from overheating or becoming damaged. Such ability may be beneficial in medical applications for example, to avoid potentially injuring a patient or otherwise being ineffective in treating the patient. The microcontroller 502 may also generate an alarm signal that generates an audible tone or visible light indicator.

The drive circuit 500 is shown as discrete electronic components. It should be understood that the drive circuit 500 may be configured as an ASIC or other integrated circuit. It should also be understood that the drive circuit 500 may be configured as an analog circuit and use an analog sinusoidal drive signal, thereby avoiding the problem with harmonic signals.

Figure 16A:
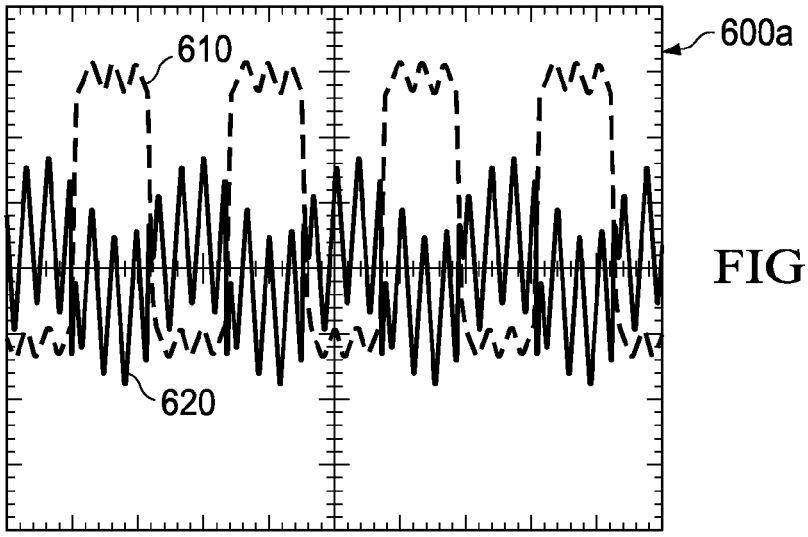
FIGS. 16A-16C are graphs showing the voltage across and current through the actuator of the disc pump shown in FIGS. 1A-2B for square-wave drive signals having 50%, 45%, and 43% frequency duty cycles, respectively.
Figure 16B:
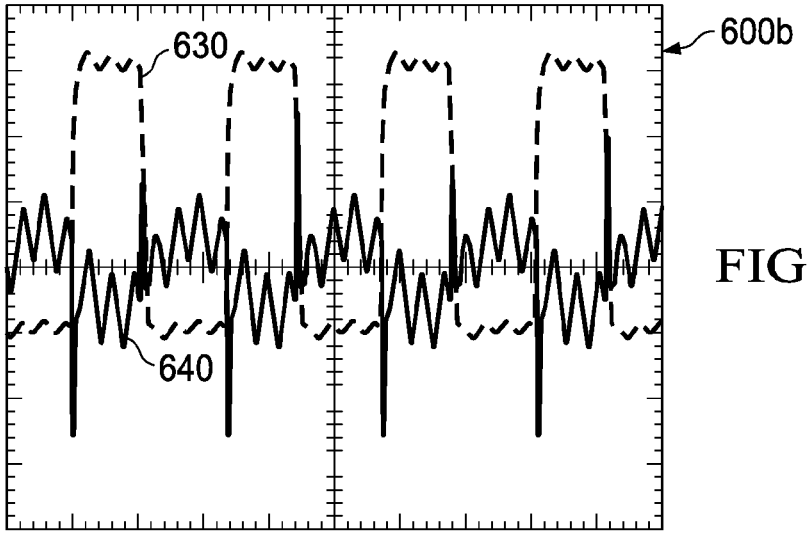
Figure 16C:
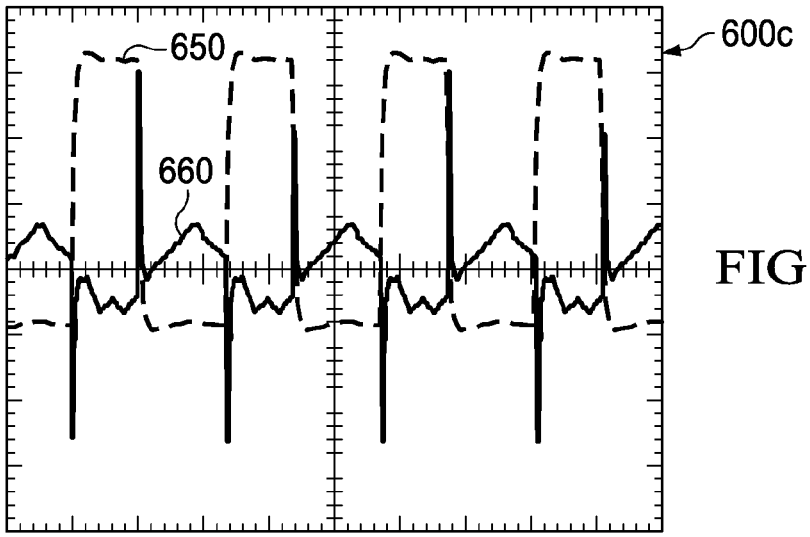

Referring now to FIGS. 16A to 16C, graphs 600A, 600B, and 600C of square-wave drive signals 610, 630, and 650 and corresponding actuator response signals, 620, 640, and 660 are shown for a 50%, 45% and 43% frequency duty cycle, respectively, with a fundamental frequency of about 21 kHz. The square-wave drive signals 610 and 630 with frequency duty cycles of 50% and 45%, respectively, contain sufficient components of the seventh harmonic to excite the fundamental breathing mode 313 of the actuator 40 as evidenced by the high frequency components in corresponding current signals 620 and 640, respectively. Such signals are evidence of significant power being delivered into the fundamental breathing mode 310 of the actuator 40 at around 147 kHz. However, when the frequency duty cycle of the square-wave drive signal is set to about 43% for the square-wave drive signal 650 shown in FIG. 16C, the content of the seventh harmonic is effectively suppressed so that the energy transfer into the fundamental breathing mode 310 of the actuator 40 significantly reduced as evidenced by the absence of high frequency components in the corresponding current signal 660 as compared to the current signals 620 and 640. In this manner, the efficiency of the pump is effectively maintained.

The impedance 300 and corresponding modes of resonance for the actuator 40 are based on an actuator having a diameter of about 22 mm where the piezoelectric disc has a thickness of about 0.45 mm and the end plate 13 has a thickness of about 0.9 mm. It should be understood that if the actuator 40 has different dimensions and construction characteristics within the scope of this application, the principles of the present invention may still be utilized by adjusting the frequency duty cycle of the square-wave signal based on the fundamental frequency so that the fundamental breathing mode of the actuator 40 is not excited by any of the harmonic components of the square-wave signal. More broadly, the principles of the present invention may be utilized to attenuate or eliminate the effects of harmonic components in the square-wave signal on the modes of resonance characterizing the structure of the actuator 40 and the performance of the disc pump 10. The principles are applicable regardless of the fundamental frequency of the square-wave signal selected for driving the actuator 40 and the corresponding harmonics.

Figure 17:
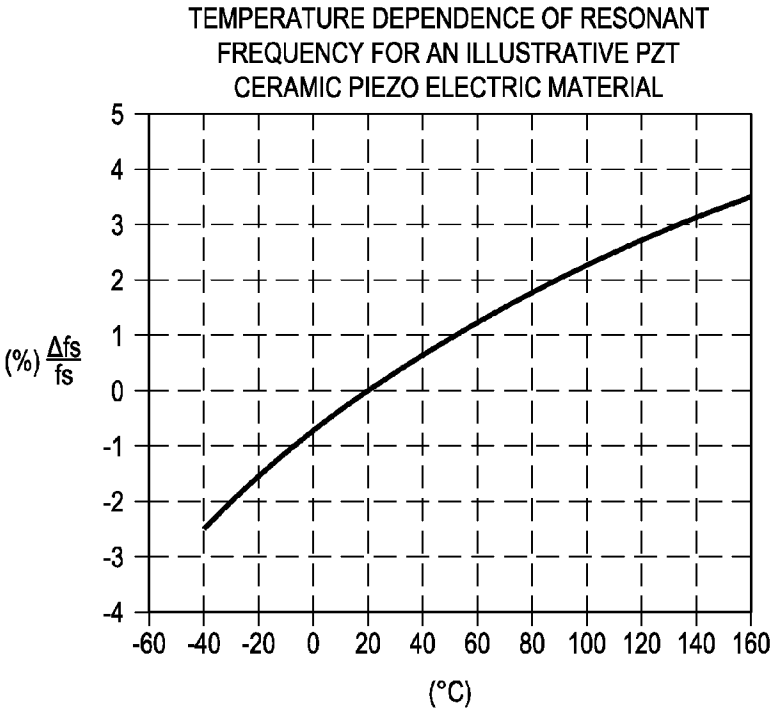
FIG. 17 is a graph illustrating the temperature dependence of the resonant frequency of an illustrative PZT ceramic piezoelectric material.

As stated above, driving the actuator at its fundamental mode of resonance maintains the efficiency of the disc pump 10. But the frequency of the fundamental resonance mode may vary depending on the temperature of the disc pump 10. This variability results from the temperature dependency of the piezoelectric material that forms the actuator 40. For example, the resonant frequency of an illustrative piezoelectric material may increase or decrease dependent on the temperature. For example, FIG. 17 shows the increase or decrease in a piezoelectric material's resonant frequency (as a percentage of the piezoelectric material's resonant frequency at 20° C.) as a function of temperature. FIG. 17 shows that the resonant frequency of the illustrative piezoelectric material which may be, for example, PZT ceramic PIC 255, made by PI Ceramic, has increased by approximately 1% at 60° C., 2.2% at 100° C., and 3% at 140° C. Considering the PZT material of FIG. 17, if the disc pump 10 is configured to operate at 60° C. during steady state operation, then 60° C. may be considered the target temperature of the disc pump 10. Based on the target temperature, the fundamental resonant frequency can be assumed to be the fundamental resonance frequency of the PZT material plus 1%. As a result of the temperature-dependent qualities of the piezoelectric material included in the actuator 40, the disc pump 10 may function less efficiently until it is "warmed up."

Typically, the frequency of the drive signal that drives the actuator 40 is configured based (in part) on the resonant frequency of the piezoelectric actuator 40. The drive signal is typically configured by assuming that disc pump 10 is operating in a steady-state, or target temperature. Since the disc pump 10 is configured to run most efficiently at the target temperature, the disc pump 10 operates less efficiently from the time the disc pump 10 is started until the time the disc pump 10 reaches the target temperature. As the disc pump 10 transitions from start-up to steady-state operation, the disc pump 10 warms and the temperature of the disc pump 10 and its components gradually transitions from the start-up temperature to the target temperature. The disc pump 10 warms as result of the dissipation of the electrical energy that drives the disc pump 10 and resultant kinetic energy.

The actuator 40 may be designed such that the resonant frequency of its fundamental mode is close to the resonant frequency of the cavity 16 at the target temperature. The resonant frequency of the actuator 40 may be higher or lower at the start up temperature, or when the temperature otherwise deviates from the target temperature. In practice, this means that the disc pump 10 will operate most efficiently when the operating temperature of the disc pump 10 is at or near the target temperature, and that the disc pump 10 will operate with less efficiency at the start-up temperature.

Generally, inherent inefficiencies in pump operation result in heating of the disc pump 10. Therefore, if the actuator 40 is selected to have a resonant frequency that is matches the resonant frequency of air in the cavity 16 at the startup temperature, the actuator 40 and air in the cavity 16 will likely not have matched resonant frequencies after the disc pump 10 has increased in temperature. Conversely, if the actuator 40 is selected to have a resonant frequency that matches the resonant frequency of air in the cavity 16 at the target temperature, the actuator 40 and air in the cavity 16 will likely not have matched frequencies at the startup temperature. In either case, the unmatched resonant frequencies may result in a decrease in the efficiency of the disc pump 10 over a given time period. By controlling the temperature of the actuator 40, the efficiency of the disc pump 10 may be improved by decreasing or eliminating the time period over which the resonant frequency of the actuator 40 and the resonant frequency of the air in the cavity 16 are unmatched. The ability to control the temperature of the actuator 40 is of particular use when the working duty cycle of the disc pump 10 is unknown. For instance, if the disc pump 10 is coupled to a load 38, e.g., a reduced-pressure wound dressing that has a leak, the disc pump 10 may remain operational almost constantly. Conversely, if the disc pump 10 is coupled to a well-sealed load 38, e.g., a reduced-pressure wound dressing that leaks very little, the disc pump 10 may never run long enough to reach the target operating temperature. In the latter implementation, the power supply of the disc pump 10, which may be a battery, may be exhausted prematurely.

To improve the efficiency of the disc pump 10, the system shown in FIG. 1, includes the actuator 40 having the heating element 60. The heating element 60 may keep the actuator 40 at the target temperature so that the resonant frequency of the actuator 40 will remain relatively constant even if the disc pump 10 is started, stopped, and restarted. The, heating element 60 may function to keep the actuator 40 at the target temperature so that, when the disc pump 10 operates, the drive signal will drive the actuator 40 at its fundamental resonance mode. In addition, the heating element 60 maintains the temperature of the actuator 40 at the target temperature when the disc pump 10 does not generate sufficient heat by virtue of its normal operation. For example, the heating element 60 may heat the actuator 40 for some time after start-up, when disc pump 10 operation is temporarily suspended, or in the stall condition.

Figure 18:
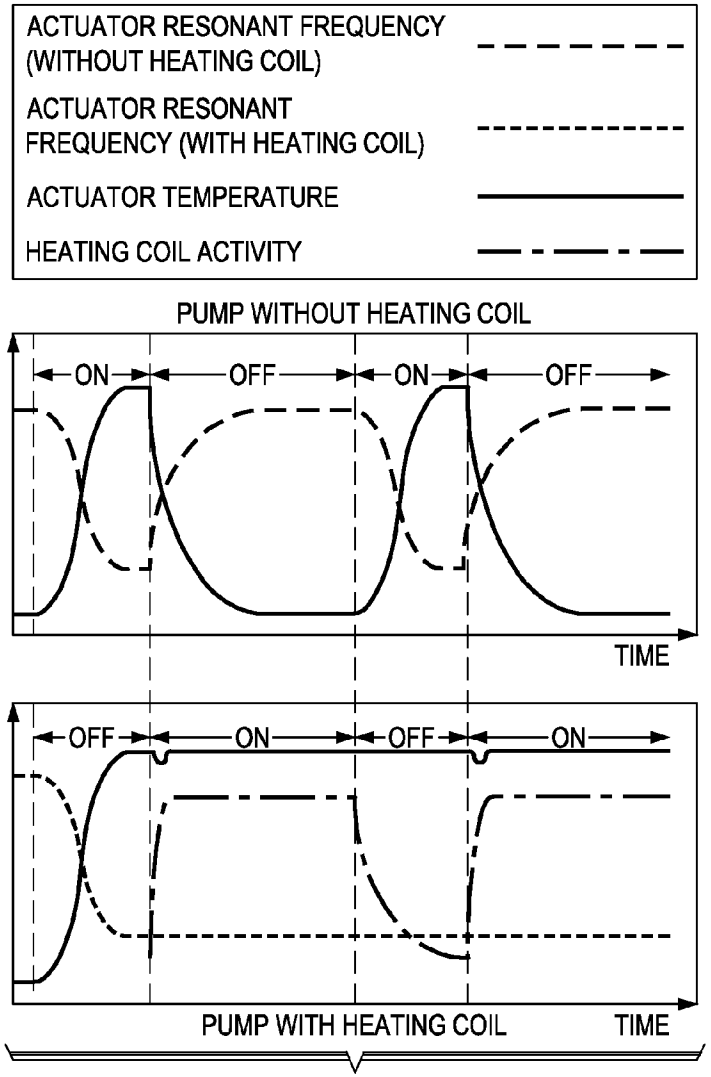
FIG. 18 is a graph showing a comparison between the operating characteristics of a disc pump that includes a heating element and a disc pump that does not include a heating element.

The parallel graphs of FIG. 18 show a comparison between the operating characteristics of a disc pump 10 that includes the heating element 60 and a disc pump 10 that does not include the heating element 60. The upper graph of FIG. 18 illustrates the operating characteristics of a pump that does not include a heating element 60, and shows that the fundamental resonant frequency of the actuator 40 fluctuates as the disc pump 10 transitions between on and off states. The lower graph illustrates the operating characteristics of the disc pump 10 that includes a heating element 60, and illustrates that the heating element 60 transitions between an off and on state to maintain the actuator 40 temperature at a target temperature despite the disc pump 10 transitioning between the on and off state. As the disc pump 10 transitions to an off state, the heating element 60 transitions to an on state and vice versa. As described above, maintaining the actuator 40 temperature at the target temperature stabilizes the fundamental resonant frequency of the actuator 40. FIG. 18 illustrates that when the disc pump 10 turns off, the actuator 40 starts to cool and the heating element 60 prevents the temperature of the actuator 40 from dropping to maintain the target temperature and associated resonant frequency. When the disc pump 10 restarts, the heating element 60 is turned off, so as to not exacerbate the heating of the actuator 40.

In an illustrative embodiment, the heating element 60 preheats the actuator 40 prior to start-up. The heating element 60 becomes inactive when the operation of the disc pump 10 generates enough heat to maintain the target temperature, and is reactivated when the disc pump 10 is temporarily stopped in order to maintain the target temperature. In this embodiment, the heating element 60 is thermally coupled to the actuator 40 and connected to a power source (not shown) through conductive elements that are integral to the isolator 30. In an embodiment, the heating element 60 is embedded within the inactive interior plate 14 that forms a portion of the actuator 40.

In an illustrative embodiment, the heating element 60 maintains the temperature of the actuator 40 at the target temperature. When the temperature of the actuator 40 is above the target temperature, the system may lower the temperature by reducing the amount of electrical current used to drive the actuator 40, thereby maintaining the actuator 40 at the target temperature. The temperature of the actuator 40 may be measured or computed by algorithm. For example, the initial temperature of the disc pump 10 may be programmed into a controller, such as microcontroller 502. The rate of heating of the actuator 40 may be computed based on empirical data or modeling and used to predict the temperature of the disc pump 10 based on the initial temperature of the disc pump 10, the rate of temperature increase (or decrease), and the elapsed time.

In another embodiment, the disc pump 10 includes a thermostat (not shown) that measures the temperature of the actuator 40. Among other components of the disc pump 10, the thermostat is communicatively coupled to the microcontroller 502 that controls the disc pump system 500. Based on temperature data received from the thermostat, the microcontroller 502 may cause the heating element 60 to supply heat to the actuator 40. In an embodiment, the addition of heat to the actuator 40 stabilizes the temperature of the actuator 40 at a temperature that is at or near the target temperature. The thermostat may be a thermistor, a thermostat output temperature sensor integrated circuit, or another type of thermostat that is suitable for application within the disc pump system 100. The thermostat may be thermally coupled to the actuator 40 or configured to monitor the temperature inside of the cavity 16 of the disc pump 10.

In another embodiment, the actuator 40 is thermally coupled to a conductive coil that is, in turn, coupled to a thermoelectric generator and a thermoelectric cooler. The thermoelectric generator and thermoelectric cooler may add or remove heat (respectively) from the actuator 40 based on whether the temperature of the actuator 40 is below or above the target temperature. In the embodiment, the microcontroller 502 causes the thermoelectric generator to add heat via the conductive coil if the actuator 40 temperature is less than the target temperature. Similarly, the microcontroller 502 causes the thermoelectric cooler to remove heat from the actuator 40 when the actuator 40 temperature is greater than the target temperature. By maintaining the temperature of the actuator 40 at the target temperature, adverse temperature effects of the disc pump 10 operation may be minimized.

Referring again to FIG. 15, the microcontroller 502 of the drive circuit 500 may include additional control circuitry to operate the heating element 60. The drive circuit may be referred to as an electronic circuit. The microcontroller 502 may include circuitry or logic enabled to control functionality of the disc pump 10. The microcontroller 502 may function as or comprise microprocessors, digital signal processors, application-specific integrated circuits (ASIC), central processing units, digital logic or other devices suitable for controlling an electronic device including one or more hardware and software elements, executing software, instructions, programs, and applications, converting and processing signals and information, and performing other related tasks. The microcontroller 502 may be a single chip or integrated with other computing or communications elements. In one embodiment, the microcontroller 502 may include or communicate with a memory. The memory may be a hardware element, device, or recording media configured to store data for subsequent retrieval or access at a later time. The memory may be static or dynamic memory in the form of random access memory, cache, or other miniaturized storage medium suitable for storage of data, instructions, and information. In an alternative embodiment, the electronic circuit may be analog circuitry that is configured to perform the same or analogous functionality for measuring the pressure and controlling the displacement of the actuator 40 in the cavities of the disc pump 10, as described above.

The drive circuit 500 may also include an RF transceiver 570 for communicating information and data relating to the performance of the disc pump 10 including, for the operating temperature of the pump via a temperature sensor (not shown), which may also be coupled to the actuator 40 or isolator 30. Generally, the drive circuit 500 may utilize a communications interface that comprises RF transceiver 570, infrared, or other wired or wireless signals to communicate with one or more external devices. The RF transceiver 570 may utilize Bluetooth, WiFi, WiMAX, or other communications standards or proprietary communications systems. Regarding the more specific uses, the RF transceiver 570 may send the signals 572 to a computing device that stores a database of pressure readings for reference by a medical professional. The computing device may be a computer, mobile device, or medical equipment device that may perform processing locally or further communicate the information to a central or remote computer for processing of the information and data. Similarly, the RF transceiver 570 may receive the signals 572 for externally regulating the pressure generated by the disc pump 10 at the load 38 based on the motion of the actuator 40.

In another embodiment, the drive circuit 500 may communicate with a user interface for displaying information to a user. The user interface may include a display, audio interface, or tactile interface for providing information, data, or signals to a user. For example, a miniature LED screen may display the pressure being applied by the disc pump 10. The user interface may also include buttons, dials, knobs, or other electrical or mechanical interfaces for adjusting the performance of the disc pump, and particularly, the reduced pressure generated. For example, the pressure may be increased or decreased by adjusting a knob or other control element that is part of the user interface.

It should be apparent from the foregoing that an invention having significant advantages has been provided. While the invention is shown in only a few of its forms, it is not so limited and is susceptible to various changes and modifications without departing from the spirit thereof.

We claim:

1. A disc pump system comprising:

a pump body having a substantially cylindrical shape defining a cavity for containing a fluid, the cavity being formed by a side wall closed at both ends by substantially circular end walls, at least one of the end walls being a driven end wall having a central portion and a peripheral portion extending radially outwardly from the central portion of the driven end wall;

an actuator operatively associated with the central portion of the driven end wall to cause an oscillatory motion of the driven end wall at a frequency (f) thereby generating displacement oscillations of the driven end wall in a direction substantially perpendicular thereto, the frequency (f) being about equal to a fundamental bending mode of the actuator;

a drive circuit having an output electrically coupled to the actuator for providing the drive signal to the actuator at the frequency (f)

an isolator operatively associated with the peripheral portion of the driven end wall to reduce damping of the displacement oscillations;

a first aperture disposed at a location in either one of the end walls other than at the annular node and extending through the pump body;

a second aperture disposed at a location in the pump body other than the location of the first aperture and extending through the pump body;

a valve disposed in at least one of the first aperture and the second aperture; whereby the displacement oscillations generate corresponding pressure oscillations of the fluid within the cavity of the pump body, causing fluid flow through the first aperture and second aperture when in use; and a heating element thermally coupled to the actuator, the heating element operable to raise the temperature of the actuator to a target temperature.

2. The disc pump system of claim 1, wherein the isolator comprises a flexible printed circuit material.

3. The disc pump system of claim 1, further comprising:

a microcontroller coupled to the heating element; and a thermostat coupled to the microcontroller.

4. The disc pump system of claim 3, wherein:

the thermostat is operable to indicate the temperature of the actuator to the microcontroller;

the microcontroller is operable to determine whether the indicated temperature is less than a target temperature and to activate the heating element in response to determining that the indicated temperature is below the target temperature.

5. The disc pump system of claim 3, wherein the heating element comprises a conductive coil thermally coupled to a thermoelectric generator, and further comprising a thermoelectric cooler coupled to the conductive coil, wherein the thermostat is operable to indicate the temperature of the actuator to the microcontroller;

the microcontroller is operable to activate the thermoelectric generator in response to determining that the indicated temperature is below the target temperature and to activate the thermoelectric cooler in response to determining that the indicated temperature is greater than the target temperature.

6. The disc pump system of claim 1, wherein the heating element comprises a resistive heating element.

7. The disc pump system of claim 1, wherein the heating element comprises a conductive coil thermally coupled to a thermoelectric generator.

8. The disc pump system of claim 1, further comprising a thermoelectric cooler coupled to a conductive coil that is thermally coupled to the actuator.

9. A method for maintaining the operating temperature of a disc pump, the method comprising:

obtaining a temperature measurement, the temperature measurement indicative of the temperature of an actuator of a disc pump;

transmitting the temperature measurement to a microcontroller of the disc pump;

determining if the temperature of the actuator is less than a target temperature; and in response to determining that the temperature of the actuator is less than the target temperature, activating a heating element that is thermally coupled to the actuator.

10. The method of claim 9, wherein the heating element is a resistive heating element.

11. The method of claim 9, wherein the heating element is a thermoelectric generator coupled to a conductive coil that is thermally coupled to the actuator.

12. The method of claim 9, further comprising:

determining if the temperature of the actuator is greater than the target temperature; and in response to determining that the temperature of the actuator is greater than the target temperature, activating a thermoelectric cooler, wherein the thermoelectric cooler is thermally coupled to the actuator.

13. The method of claim 9, wherein obtaining a temperature measurement, comprises obtaining the temperature measurement with a thermostat.

14. The method of claim 13, wherein the thermostat is a thermistor.

15. The method of claim 13, wherein the thermostat is a thermostat output temperature sensor integrated circuit.

16. A disc pump comprising:

a pump body having a substantially cylindrical shape defining a cavity for containing a fluid, the cavity being formed by a side wall closed at both ends by substantially circular end walls, at least one of the end walls being a driven end wall having a central portion and a peripheral portion extending radially outwardly from the central portion of the driven end wall;

an actuator operatively associated with the central portion of the driven end wall to cause an oscillatory motion of the driven end wall at a frequency (f) thereby generating displacement oscillations of the driven end wall in a direction substantially perpendicular thereto, the frequency (f) being about equal to a fundamental bending mode of the actuator;

a drive circuit having an output electrically coupled to the actuator for providing the drive signal to the actuator at the frequency (f)

an isolator operatively associated with the peripheral portion of the driven end wall to reduce damping of the displacement oscillations, the isolator comprising a flexible printed circuit material;

a first aperture disposed at a location in either one of the end walls other than at the annular node and extending through the pump body;

a second aperture disposed at a location in the pump body other than the location of the first aperture and extending through the pump body;

a valve disposed in at least one of the first aperture and the second aperture; whereby the displacement oscillations generate corresponding pressure oscillations of the fluid within the cavity of the pump body, causing fluid flow through the first aperture and second aperture when in use; and a heating element thermally coupled to a power source via conductive elements that are integral to the isolator.

17. The disc pump of claim 16, further comprising:

a microcontroller coupled to the heating element; and a thermostat coupled to the microcontroller.

18. The disc pump of claim 17 wherein:

the thermostat is operable to indicate the temperature of the actuator to the microcontroller;

the microcontroller is operable to determine whether the indicated temperature is less than a target temperature and to activate the heating element in response to determining that the indicated temperature is below the target temperature.

19. The disc pump system of claim 17, wherein the heating element comprises a conductive coil thermally coupled to a thermoelectric generator, and further comprising a thermoelectric cooler coupled to the conductive coil, wherein the thermostat is operable to indicate the temperature of the actuator to the microcontroller;

the microcontroller is operable to activate the thermoelectric generator in response to determining that the indicated temperature is below the target temperature and to activate the thermoelectric cooler in response to determining that the indicated temperature is greater than the target temperature.

20. The disc pump system of claim 16, wherein the heating element comprises a resistive heating element.

21. The disc pump system of claim 16, wherein the heating element comprises a conductive coil thermally coupled to a thermoelectric generator.

22. The disc pump system of claim 16, further comprising a thermoelectric cooler coupled to a conductive coil that is thermally coupled to the actuator.

* * * * *